US011751634B2

(12) United States Patent
Chen

(10) Patent No.: US 11,751,634 B2
(45) Date of Patent: Sep. 12, 2023

(54) FASTENING DEVICE AND LACE ASSEMBLING METHOD

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 155 days.

(21) Appl. No.: 17/144,156

(22) Filed: Jan. 8, 2021

(65) Prior Publication Data

US 2021/0127795 A1 May 6, 2021

Related U.S. Application Data

(63) Continuation-in-part of application No. 16/095,940, filed as application No. PCT/CN2016/105490 on Nov. 11, 2016, now Pat. No. 10,918,165.

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 11/00; A43C 11/16; A43C 11/20; A43C 1/003; A43C 1/06; A43C 1/00
See application file for complete search history.

(56) References Cited

U.S. PATENT DOCUMENTS

| | | | | |
|---|---|---|---|---|
| 8,353,087 | B2 | 1/2013 | Chen | |
| 2008/0196224 | A1 | 8/2008 | Hu | |
| 2010/0139057 | A1 | 6/2010 | Soderberg et al. | |
| 2010/0299959 | A1* | 12/2010 | Hammerslag | A43C 1/04 36/50.5 |
| 2014/0359981 | A1 | 12/2014 | Cotterman et al. | |
| 2015/0014463 | A1 | 1/2015 | Converse et al. | |
| 2015/0313319 | A1 | 11/2015 | Ha | |
| 2016/0058130 | A1 | 3/2016 | Boney et al. | |
| 2021/0127794 | A1 | 5/2021 | Chen | |
| 2021/0127795 | A1 | 5/2021 | Chen | |

FOREIGN PATENT DOCUMENTS

| | | | |
|---|---|---|---|
| CN | 201015448 | Y | 2/2008 |
| CN | 101843388 | A | 9/2010 |
| CN | 202218653 | U | 5/2012 |
| CN | 203492894 | U | 3/2014 |
| CN | 104394730 | A | 3/2015 |
| CN | 104839942 | A | 8/2015 |
| CN | 204895922 | U | 12/2015 |
| CN | 205267176 | U | 6/2016 |
| CN | 205432385 | U | 8/2016 |
| CN | 108377640 | A | 8/2018 |

(Continued)

*Primary Examiner* — Jack W Lavinder
(74) *Attorney, Agent, or Firm* — CKC & Partners Co., LLC

(57) ABSTRACT

A fastening device is provided. The fastening device includes a case, a spool, a knob and a locking unit. When the knob is rotated relative to the case in a fastening direction, the spool is not affected by the locking unit and is allowed to rotate in the fastening direction for fastening the lace. When the knob is rotated relative to the case in a loosening direction, the spool is allowed to freely rotate in the loosening direction to release the lace. As the knob is engaged with the housing via an engagement between the mounted portion and the engaged portion, the housing, the locking unit, the knob and the spool are combined and restricted.

2 Claims, 46 Drawing Sheets

(56) References Cited

FOREIGN PATENT DOCUMENTS

| | | | |
|---|---|---|---|
| CN | 110049694 | A | 7/2019 |
| CN | 111114877 | A | 5/2020 |
| CN | 111115388 | A | 5/2020 |
| CN | 111846339 | A | 10/2020 |
| DE | 202011101828 | U1 | 8/2011 |
| DE | 202016104318 | U1 | 11/2016 |
| JP | H07208 | A | 1/1995 |
| JP | 3202821 | U | 2/2016 |
| JP | 2016-165490 | A | 9/2016 |
| KR | 20100009337 | U | 9/2010 |
| KR | 101040372 | B1 | 6/2011 |
| KR | 101053551 | B1 | 8/2011 |
| KR | 20130040141 | A | 4/2013 |
| KR | 20150097389 | A | 8/2015 |
| TW | 201127310 | A | 8/2011 |
| TW | 201429420 | A | 8/2014 |

* cited by examiner

700

100c

100d

100e

100f

100f

100f

100g

100g

100h

100h

100i

100i

100i

100j

100j

100k

1001

100m

100n

100p

100p

100q

100r

100s

FASTENING DEVICE AND LACE ASSEMBLING METHOD

RELATED APPLICATIONS

This application is a Continuation-in-part of U.S. application Ser. No. 16/095,940, filed on Oct. 23, 2018, which is a continuation of International application No. PCT/CN2016/105490, filed Nov. 11, 2016, the content of which are incorporated herein by reference.

BACKGROUND

Technical Field

The present disclosure relates to a fastening device and a lace assembling method thereof. More particularly, the present disclosure relates to a fastening device and a lace assembling method thereof for securing an article through loosening or tightening a lace.

Description of Relative Art

In daily life, cords, such as a lace or a thread, are usually used to tighten articles. The most common tightening method is to use the cord to reciprocately pass through holes on the article, such as eyelets of a shoe, and then tie a knot to secure the article. But in this kind of tightening method, the knot is loosened easily because of an external force. Not only does the knot need to be tied again, but also lots of inconveniences come owning to the insecurity of the articles.

In order to solve such problems, some practitioners developed a simple fastening mechanism including a case, an engaging unit and a spring. The case includes holes to allow the lace to pass therethrough. Through the reaction force between the spring and the engaging unit, the lace can be clamped between the engaging unit and the case so as to be fastened. The length of the lace can be changed by pressing the spring to change the position of the engaging unit. However, in such fastening mechanism, the restoring force of the spring is served as the securing force; thus, the lace is easily to be released owing to vibrations or an external force. In addition, the fastening mechanism has no space to receive the lace, and the exposure of the lace may bring danger.

Therefore, some practitioners developed another kind of buckle which can be rotated to tighten the lace, and the lace can be received inside the buckle. Through the interference between components inside the buckle, the length of the lace as well as the tightness can be adjusted. However, the structure of the buckles is complex; as a result, the manufacturing cost is increased, and the buckle has assembly and repair difficulty.

Base on the above-mentioned problems, how to simplify the structure of the fastening device, reduce the manufacturing cost and maintain the securing capability becomes a pursuit target for practitioners.

SUMMARY

Disclosure of Invention

According to one embodiment of the present disclosure, a fastening device which is for fastening and loosening a lace is provided. The fastening device includes a case, a spool, a knob and a locking unit. The case includes a housing including a receiving space, a base detachably connected to the housing and a mounted portion located on the housing. The spool is received in the receiving space and configured for the lace to be wound therearound. The knob includes an engaged portion for engaging with the mounted portion such that the knob is coupled to the housing. A relative position between the engaged portion and the mounted portion is fixed during an operation of the fastening device. The locking unit is received in the receiving space. When the knob is rotated relative to the case in a fastening direction, the spool is not affected by the locking unit and is allowed to rotate in the fastening direction for fastening the lace. When the knob is rotated relative to the case in a loosening direction, the spool is allowed to freely rotate in the loosening direction to release the lace. As the knob is engaged with the housing via an engagement between the mounted portion and the engaged portion, the housing, the locking unit, the knob and the spool are combined and restricted.

According to another embodiment of the present disclosure, a lace assembling method which is for connecting a lace to a fastening device is provided. The lace assembling method includes providing a fastening device and providing a lace coupling process. The fastening device includes a case, a spool, a knob and a locking unit. The case includes a housing and a base detachably connected to the housing. The knob includes an engaged portion for engaging a mounted portion on the housing. The spool is disposed inside the housing. The locking unit is disposed inside the housing. As the knob is engaged with the housing via an engagement between the mounted portion and the engaged portion, the housing, the locking unit, the knob and the spool are combined and restricted, and a relative position between the engaged portion and the mounted portion is fixed during an operation of the fastening device. A first end of the lace and a second end of the lace are exposed from a lower opening of the housing after passing through the housing and the spool, such that a user knot the first end and the second end to allow the lace to be coupled to the spool.

DETAILED DESCRIPTION

The embodiment will be described with the drawings. For clarity, some practical details will be described below. However, it should be noted that the present disclosure should not be limited by the practical details. That is, in some embodiment, the practical details are unnecessary. In addition, for simplifying the drawings, some conventional structures and elements will be simply illustrated, and repeated elements may be represented by the same labels.

Figure 1:
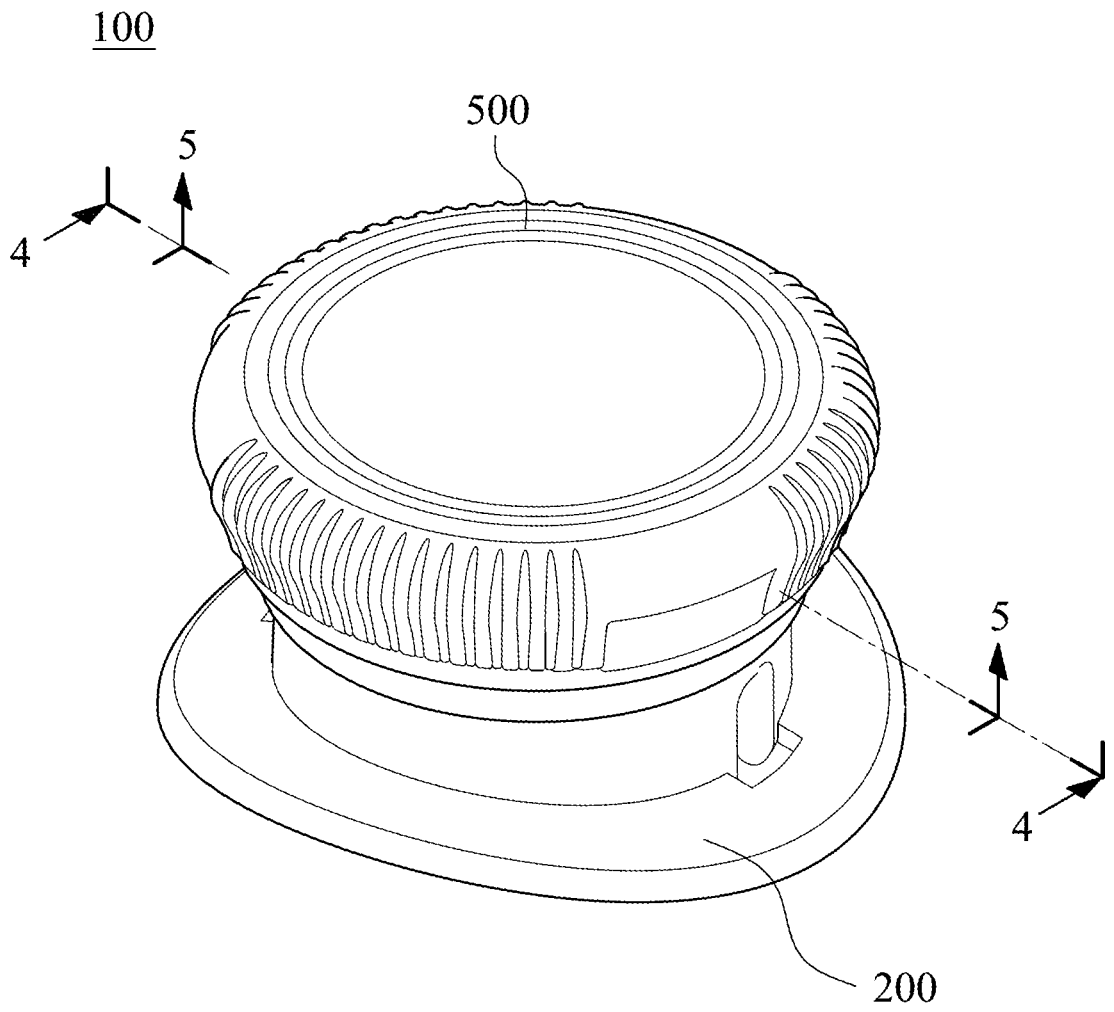
FIG. 1 shows a three dimensional schematic view of a fastening device according to a 1st embodiment of the present disclosure.
Figure 2A:
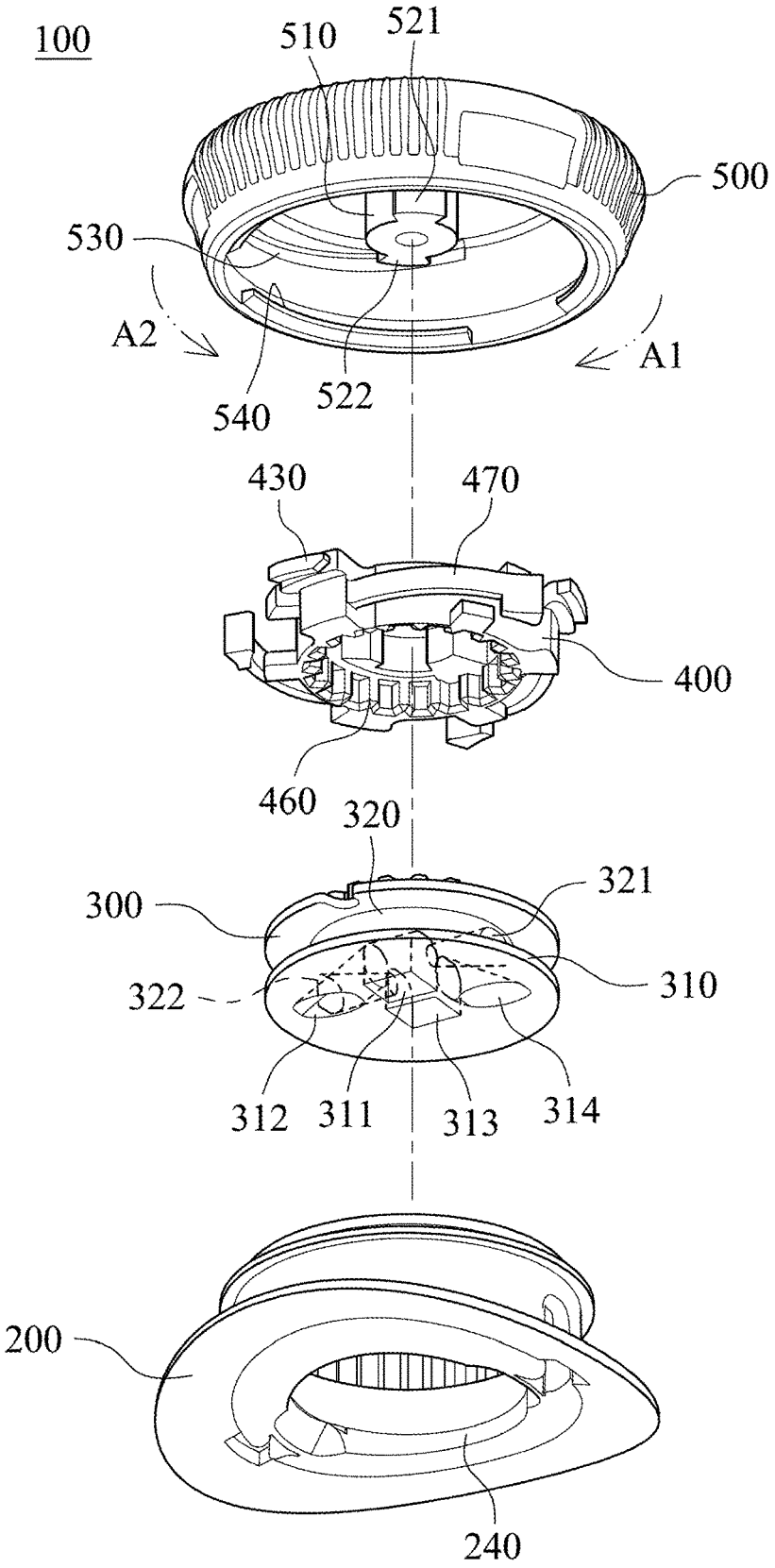
FIG. 2A shows one exploded view of the fastening device of FIG. 1.
Figure 2B:
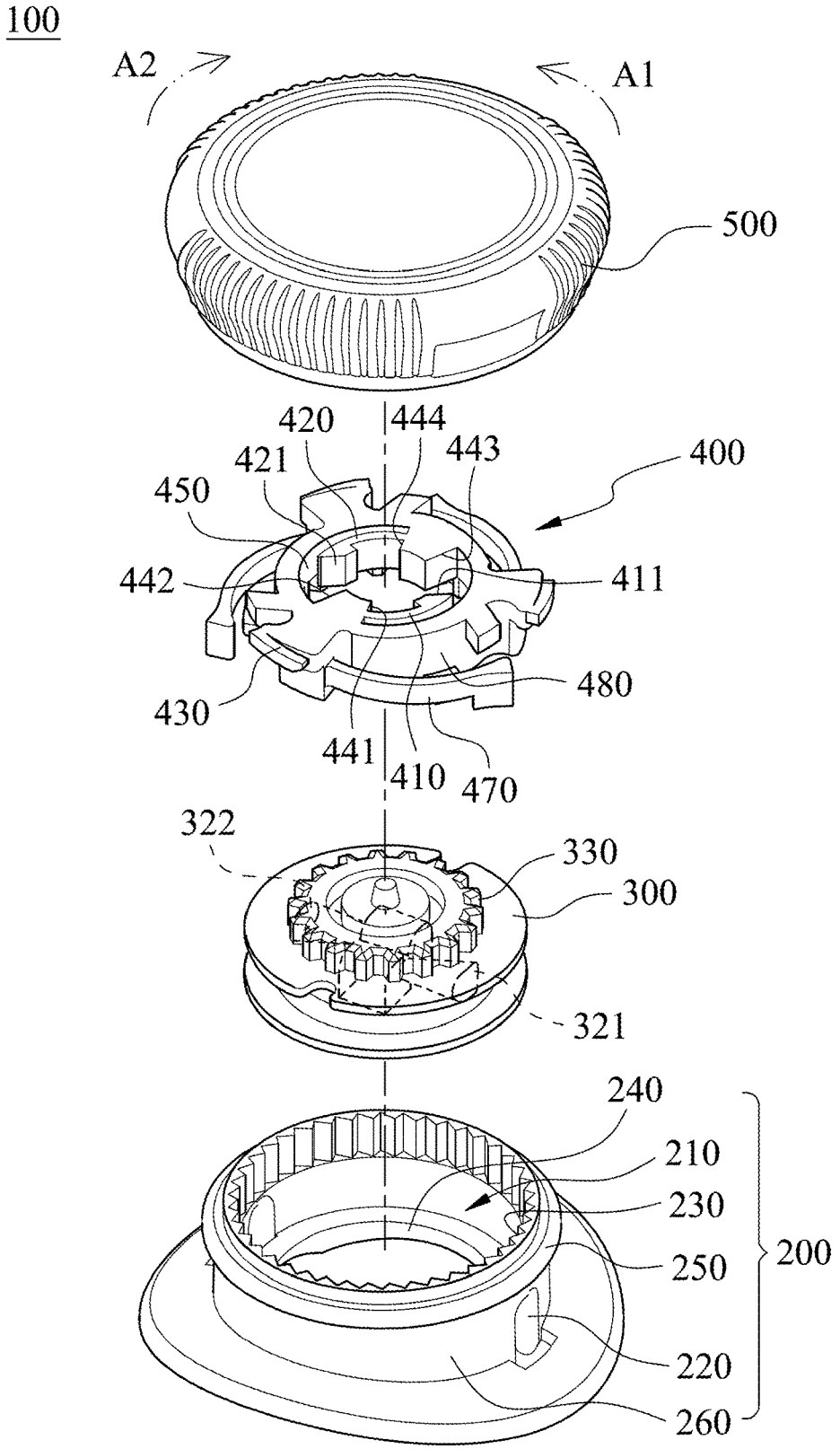
FIG. 2B shows another exploded view of the fastening device of FIG. 1.

Please refer to FIG. 1, FIG. 2A and FIG. 2B, wherein FIG. 1 shows a three dimensional schematic view of a fastening device 100 according to a 1st embodiment of the present disclosure, FIG. 2A shows one exploded view of the fastening device 100 of FIG. 1, and FIG. 2B shows another exploded view of the fastening device 100 of FIG. 1.

The fastening device 100 which is for fastening and loosening a lace 600 is composed of a case 200, a spool 300, a knob 500 and a locking unit 400, wherein the case 200 includes a mounted portion 250; the spool 300 is disposed at the case 200 and a lace 600 is wound therearound; the knob 500 includes an engaged portion 540 for engaging with the mounted portion 250, such that the knob 500 is coupled to the case 200; the locking unit 400 is coupled to the knob 500 and is driven by the knob 500, the locking unit 400 is switched from a first position to a second position by rotating the knob 500 relative to the case 200, the locking unit 400 is coupled to the spool 300 to prohibit the spool 300 from rotating toward a loosening direction A1 when the locking unit 400 is at the first position, and the spool 300 is allowed to be rotated toward the loosening direction A1 when the locking unit 400 is at the second position.

Therefore, since the fastening device 100 is composed of the case 200, the spool 300, the knob 500 and the locking unit 400, through the engaging relationship between the case 200 and the knob 500, the structure of the fastening device 100 can be simplified while the securing capability of the fastening device 100 is remained. The detail structure and operation of the fastening device 100 will be described in the following paragraphs.

The case 200 has a hollow structure, and includes a housing 260, the housing 260 includes a receiving space 210, a plurality of inner teeth 230, two side holes 220 and a lower opening 240. The inner teeth 230 face to the receiving space 210, the two side holes 220 and the lower opening 240 are communicated with the receiving space 210, and the mounted portion 250 is protruded outwardly from the housing 260 and is ring-shaped. In the 1st embodiment, a diameter of the lower opening 240 is smaller than a diameter of the spool 300, and after the spool 300 is disposed inside the receiving space 210 of the housing 260, it will not fall out from the lower opening 240.

The spool 300 is disc-shaped, and includes a spool cylinder 320 and a bottom 310, the spool cylinder 320 includes a first opening 321 and a second opening 322, the bottom 310 is for disposing the spool cylinder 320, the bottom 310 includes a first knotting hole 311, a first through hole 312, a second knotting hole 313 and a second through hole 314, the first knotting hole 311 and the first through hole 312 are communicated with the first opening 321, and the second knotting hole 313 and the second through hole 314 are communicated with the second opening 322. A first end and a second end of the lace 600 can pass through the first opening 321 and the second opening 322, respectively, to couple with the spool 300, such that the lace 600 can be wound around the spool cylinder 320. In addition, the spool 300 can further include a plurality of engaging teeth 330 for engaging with the locking unit 400. The spool 300 includes two sloped surfaces 316, one of the sloped surface 316 is located in the first through hole 312, and the other one of the sloped surface 316 is located in the second through hole 314. The first end of the lace 600 passes through the first opening 321 toward the sloped surface 316 in the first through hole 312, and the second end of the lace 600 passes through the second opening 322 toward the sloped surface 316 in the second through hole 314.

The locking unit 400 includes a ring body 480, a first retaining portion 410, a second retaining portion 420, three guiding portions 430, four stopping portions 441, 442, 443, 444, a communicated hole 450, a plurality of engaged teeth 460 and three pawl arms 470. The ring body 480 has a radial direction, the first retaining portion 410 and the second retaining portion 420 are disposed at the ring body 480 and are coupled to the knob 500, the guiding portions 430 having inclined block structure are protruded outwardly from the ring body 480 along the radial direction and are used for coupling to the knob 500, the pawl arms 470 are disposed at the ring body 480, which are protruded outwardly from the ring body 480 along the radial direction and are for used coupling to the inner teeth 230, and the first retaining portion 410 and the second retaining portion 420 are protruded inwardly along the radial direction, that is, protruded toward a center of the ring body 480. The engaged teeth 460 are disposed at a distal end of a wall of the communicated hole 450, which is close to the spool 300, and the four stopping portions 441, 442, 443, 444 are protruded toward the center from a proximal end of the wall of the communicated hole 450, which is close to the knob 500, the stopping portions 441, 443 are corresponding to each other, and the stopping portions 442, 444 are corresponding to each other.

Each of the first retaining portion 410 and the second retaining portion 420 has restoring capability in the radial direction, precisely, the first retaining portion 410 has a first free end 411, the second retaining portion 420 has a second free end 421, when each of the first free end 411 and the second free end 421 bears a force applied thereon being larger than the force they can bear, they would be deformed in the radial direction, and when the external force is removed, the first free end 411 and the second free end 421 restore.

In addition to the engaged portion 540, the knob 500 further includes a protruding cylinder 510, two protrusions 521, 522 (shown in FIG. 2A) and a spiral track 530. The protruding cylinder 510 is protruded toward the locking unit 400, the two protrusions 521, 522 are positioned at the protruding cylinder 510 and are corresponding to each other, the protruding cylinder 510 and the protrusions 521, 522 are protruded into the communicated hole 450 when assembling, such that when the locking unit 400 is at the first position, the protrusion 521 is abutted against the first retaining portion 410, and the second protrusion 522 is abutted against the second retaining portion 420. The spiral track 530 is disposed at an inner wall (not labeled) of the knob 500 for coupling to the guiding portions 430, the engaged portion 540 is also disposed at the inner wall, and has a groove structure corresponding to the mounted portion 250.

Figure 3A:
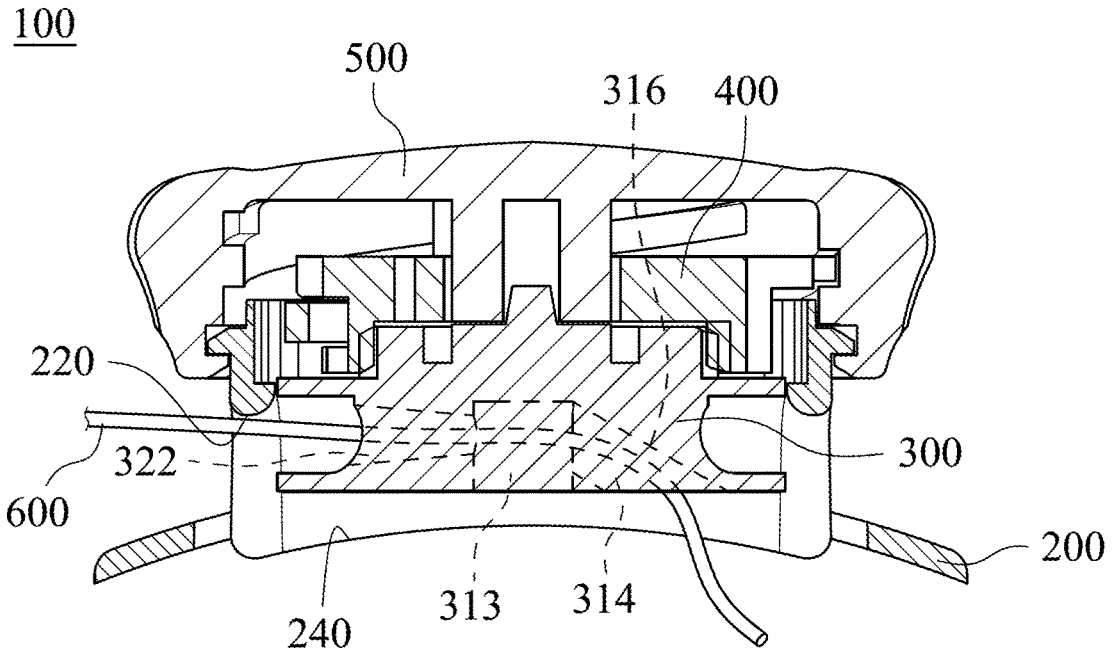
FIGS. 3A to 3C show illustrations of a lace coupling process for the lace of the fastening device of FIG. 1.
Figure 3B:
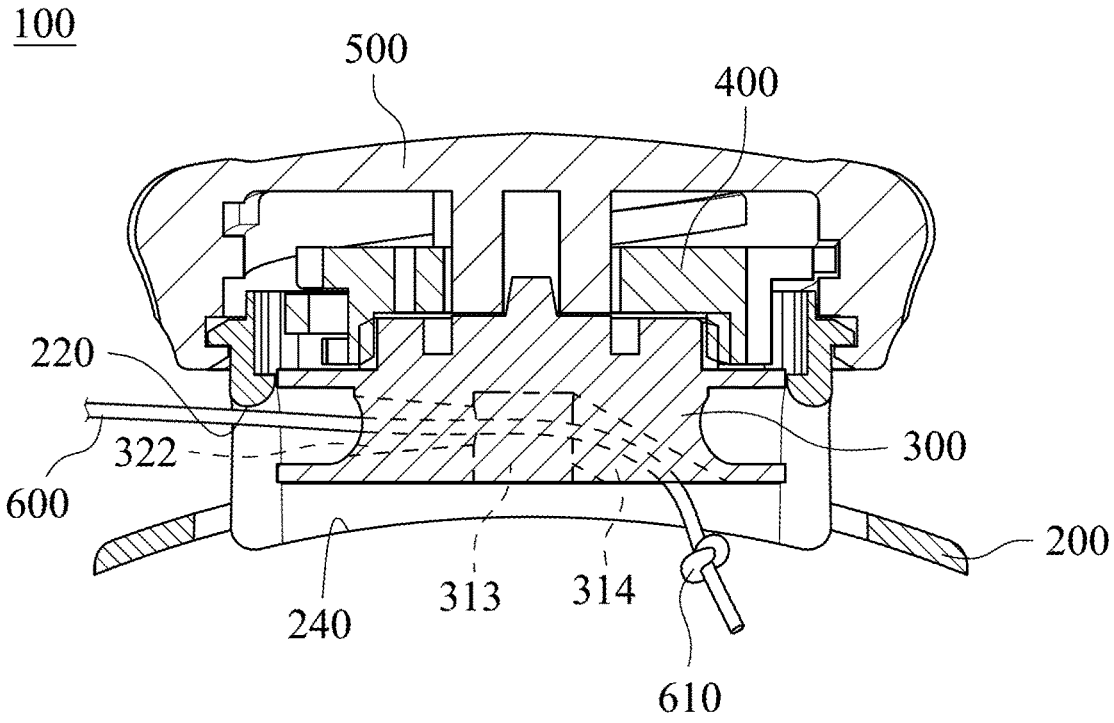
Figure 3C:
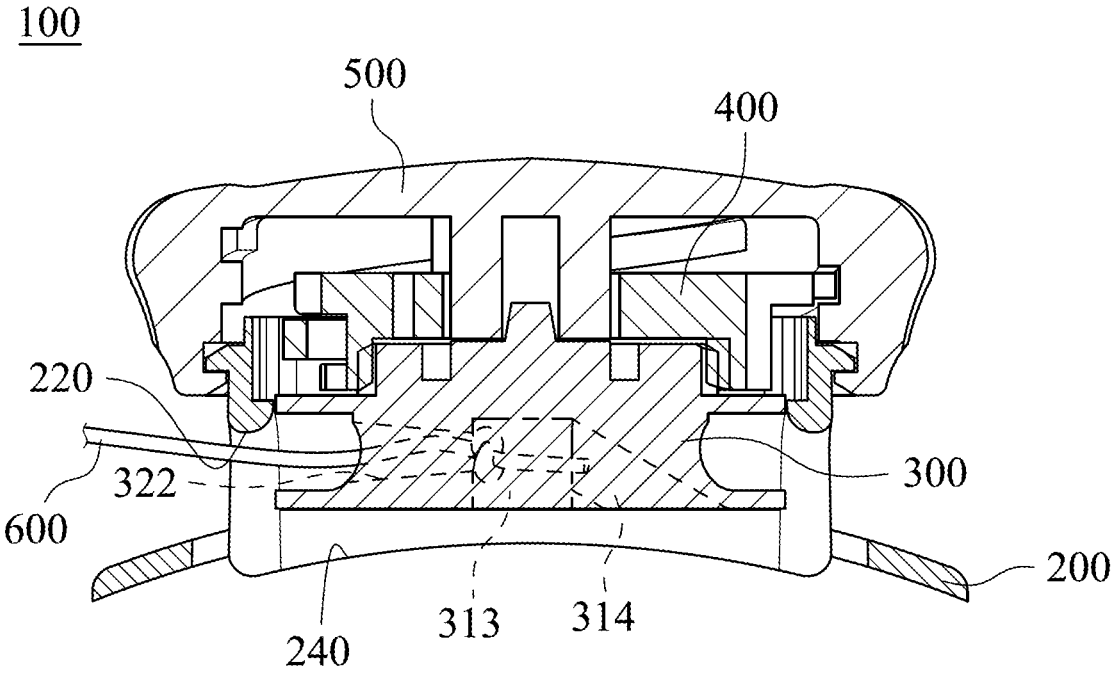

Please refer to FIGS. 3A to 3C, wherein FIGS. 3A to 3C show illustrations of a lace coupling process for the lace 600 of the fastening device 100 of FIG. 1. When assembling the fastening device 100, the spool 300 can be disposed inside the case 200 first, and after the knob 500 is assembled with the locking unit 400, the knob 500 can be covered on the case 200, finally a force can be applied to engage the engaged portion 540 of the knob 500 with the mounted portion 250 of the case 200, such that assembly of the fastening device 100 can be completed.

When the lase 600 is going to be coupled to the spool 300, as shown in FIG. 3A, the second end (not labeled) of the lase 600 can be passed through one of the side holes 220, the second opening 322, the second knotting hole 313 and the second through hole 314, such that the second end is exposed from the lower opening 240. As shown in FIG. 3B, a user (not shown) can tie the second end into a knot 610 and a tail (not labeled), and as shown in FIG. 3C, the lace 600 can be pulled from the second opening 322 by the user, such that the knot 610 can be moved into the second knotting hole 313 so as to be limited in the second knotting hole 313, the tail is left in the second through hole 314, and will not be exposed from the lower opening 240.

Similarly, the first end of the lace 600 (which is opposite to the second end) can be passed through the other one of the side holes 220, the first opening 321, the first knotting hole 311 and the first through hole 312 such that the first end is exposed from the lower opening 240, the user can tie the first end into another knot and another tail (not shown), then the knot can be limited in the first knotting hole 311, and the tail can be left in the first through hole 312.

Figure 4A:
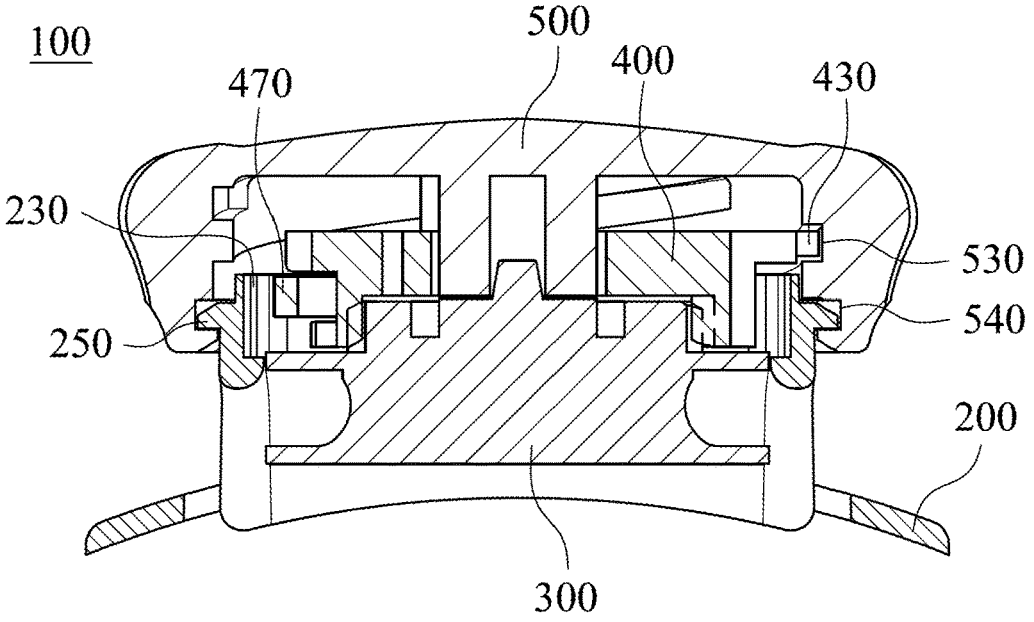
FIG. 4A shows one cross-sectional view of the fastening device of FIG. 1 taken along Line 4-4.
Figure 4B:
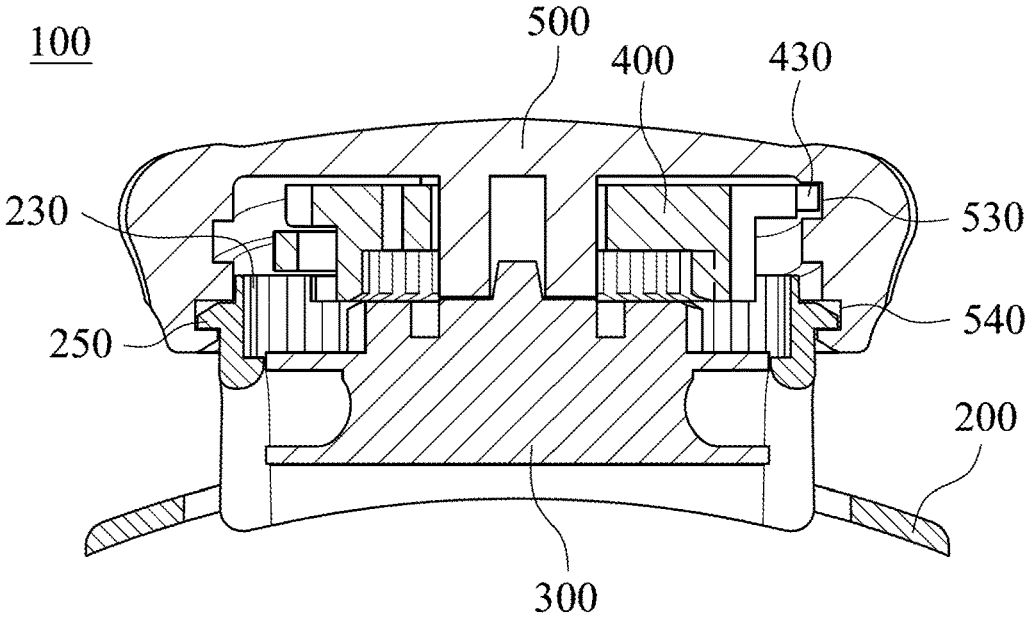
FIG. 4B shows another cross-sectional view of the fastening device of FIG. 1 taken along Line 4-4.

Please refer to FIG. 4A and FIG. 4B, and also refer to FIGS. 2A and 2B together, wherein FIG. 4A shows one cross-sectional view of the fastening device 100 of FIG. 1 taken along Line 4-4, and FIG. 4B shows another cross-sectional view of the fastening device 100 of FIG. 1 taken along Line 4-4.

As shown in FIG. 4A, the guiding portions 430 (shown in FIG. 2B) can be limitedly moved along the spiral track 530 (shown in FIG. 2A), that is, when the knob 500 is rotated relative to the locking unit 400, the guiding portions 430 are moved along the spiral track 530, such that the locking unit 400 is lifted or lowered relative to the knob 500. As shown in FIG. 3A, when the locking unit 400 is at the first position, the pawl arms 470 (shown in FIG. 2B) are coordinated with the inner teeth 230 (shown in FIG. 2B), and the engaged teeth 460 (shown in FIG. 2A) are engaged with the engaging teeth 330 (shown in FIG. 2B), the pawl arms 470 are disengaged with the inner teeth 230 in the tightening direction A2 (shown in FIG. 2B) while engaged with the inner teeth 230 in the loosening direction A1 (shown in FIG. 2B) owing to the structure thereof; as a result, when the knob 500 is rotated toward the tightening direction A2 to drive the locking unit 400, the spool 300 linked up therewith can retract the lace 600, when the knob 500 is stopped, the pawl arms 470 are engaged with the inner teeth 230 to prohibit the spool 300 from rotating toward the loosening direction A1, and a securing purpose can be achieved.

As shown in FIG. 4B, the locking unit 400 is at the second position when the knob 500 is rotated toward the loosening direction A1 to move the guiding portions 430, since the pawl arms 470 are not engaged with the inner teeth 230, the spool 300 can free rotate toward the loosening direction A1, hence, the lace 600 can be pulled out to achieve a releasing purpose. In the 1st embodiment, the engaged teeth 460 are disengaged with the engaging teeth 330 to allow the locking unit 400 to be disengaged with the spool 300 when the locking unit 400 is at the second position, but in other embodiments, the engaged teeth 460 and the engaging teeth 330 can be engaged at the second position, while the pawl arms 470 are disengaged with the inner teeth 230, or the pawl arms 470 are engaged with the inner teeth 230 at the second position, while the engaged teeth 460 are disengaged with the engaging teeth 330, and will not be limited thereto.

Figure 5A:
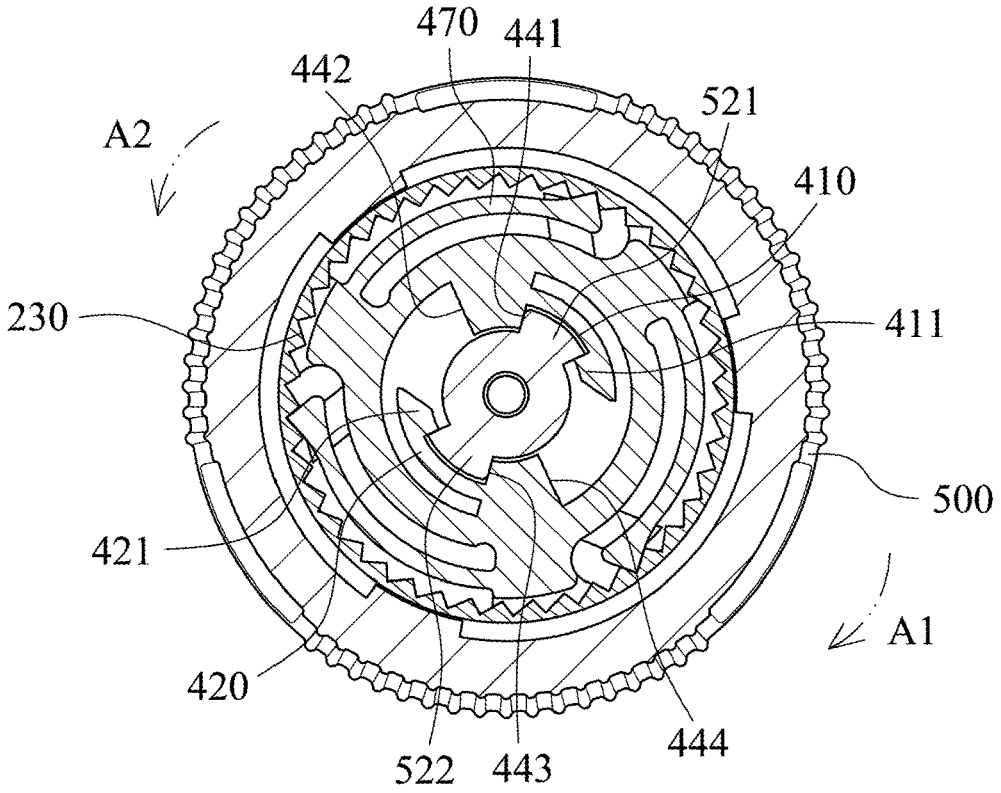
FIG. 5A shows one cross-sectional view of the fastening device of FIG. 1 taken along Line 5-5.
Figure 5B:
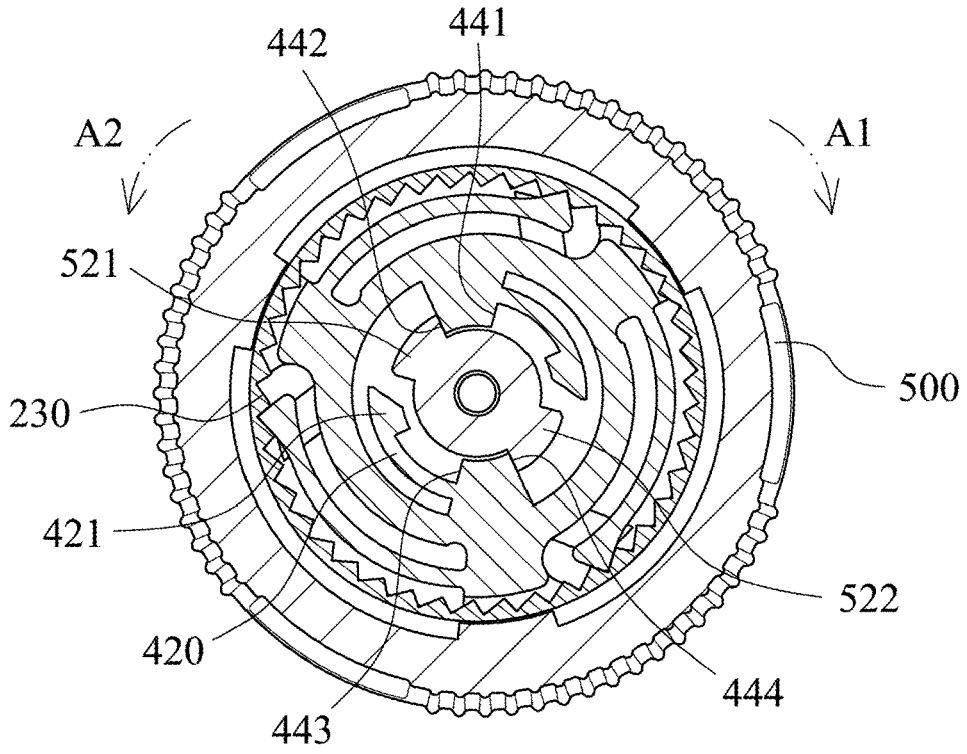
FIG. 5B shows another cross-sectional view of the fastening device of FIG. 1 taken along Line 5-5.

Please refer to FIG. 5A and FIG. 5B, wherein FIG. 5A shows one cross-sectional view of the fastening device 100 of FIG. 1 taken along Line 5-5, and FIG. 5B shows another cross-sectional view of the fastening device 100 of FIG. 1 taken along Line 5-5.

As shown in FIG. 5A, the locking unit 400 is at the first position, the protrusion 521 is abutted against the first retaining portion 410 and the stopping portion 441, the protrusion 522 is abutted against the second retaining portion 420 and the stopping portion 443, thus the knob 500 (shown in FIG. 2A) is engaged with the locking unit 400, and when the knob 500 is rotated toward the tightening direction A2, the protrusion 521 presses the stopping portion 441, the protrusion 522 presses the stopping unit 443, such that the locking unit 400 is driven to rotate. On the other hand, when the knob 500 is stopped, owning to the configuration of the first retaining portion 410 and the second retaining portion 420, the protrusion 521 and the protrusion 522 can be abutted for maintaining the relative position of the knob 500 and the locking unit 400, such that it is favorable for preventing the position of the knob 500 and the engaging unit 400 from being moved by the external force (which is a vibrating force in the environment during using, not the force applied by the user) to lead the lace 600 to be released.

When the knob 500 is rotated toward the loosening direction A1, because of the engagement between the pawl arms 470 and the inner teeth 230, the locking unit 400 cannot be rotated, thus the protrusion 521 presses the first free end 411 of the first retaining portion 410 when forced, the protrusion 522 presses the second free end 421 of the second retaining portion 420 when forced, the first free end 411 and the second free end 421 are deformed to move along the radial direction because they can no bear the force, and as shown in FIG. 5B, when the knob 500 is rotated relative to the locking unit 400, the protrusion 521 is abutted against the stopping portion 444 and the protrusion 522 is abutted against the stopping portion 442, the first free end 411 and the second free end 421 restore after the force eliminated. Hence, when the knob 500 is rotated relative to the locking unit 400, the guiding portions 430 are moved along the spiral track 530, and the locking unit 400 is driven to change from the first position to the second position.

In addition, if the knob 500 is rotated toward the tightening direction A2 again, the protrusion 521 will touch the first free end 411 first and then press the first free end 411, the protrusion 522 will tough the second free end 421 first and then press the second free end 421, because the locking unit 400 is lowered to a position between the first position and the second position, the pawl arms 470 are engaged with the inner teeth 230, and before the pawl arms 470 are disengaged with the inner teeth 230 in the tightening direction A2, the pawl arms 470 must be deformed in the radial direction. The first free end 411 and the second free end 421 have to be deformed along the radial direction to allow the locking unit 400 to be switched to the first position in the configuration.

In other embodiments, the structures of the first retaining portion and the second retaining portion can be changed, the retaining portion can couple to the knob, or coupled to the case, only when it has a capability to maintain the relative position of the knob and the locking unit to prohibit the locking unit from being lifted or lowered under a certain force, and the number of the retaining portion and the number of the mounted portion are no limited.

Figure 6:
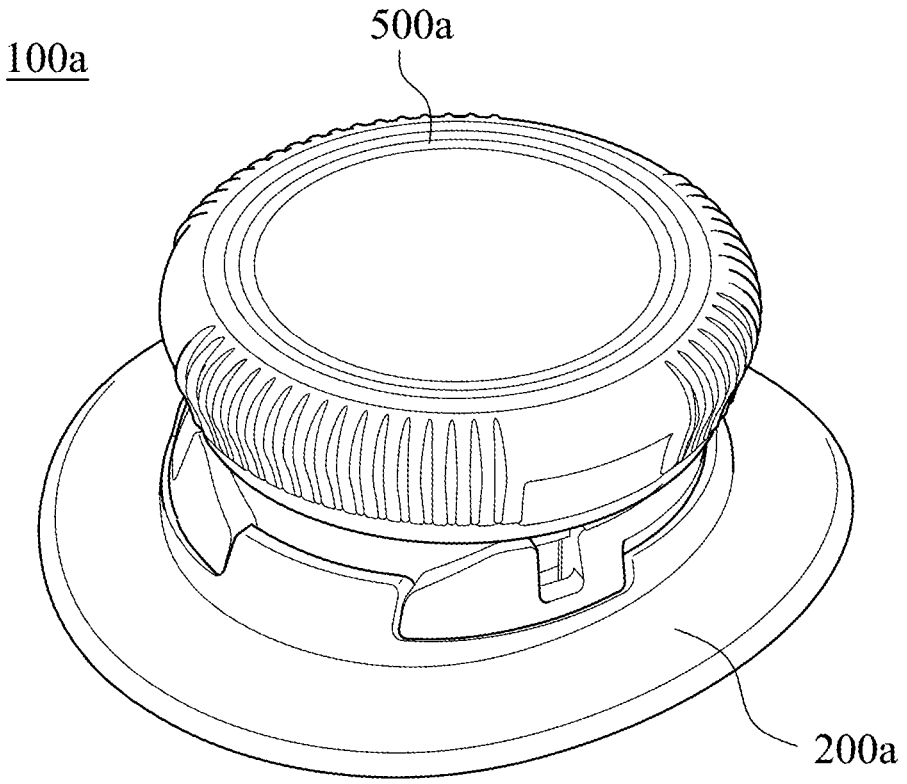
FIG. 6 shows a three dimensional schematic view of a fastening device according to a 2nd embodiment of the present disclosure.
Figure 7A:
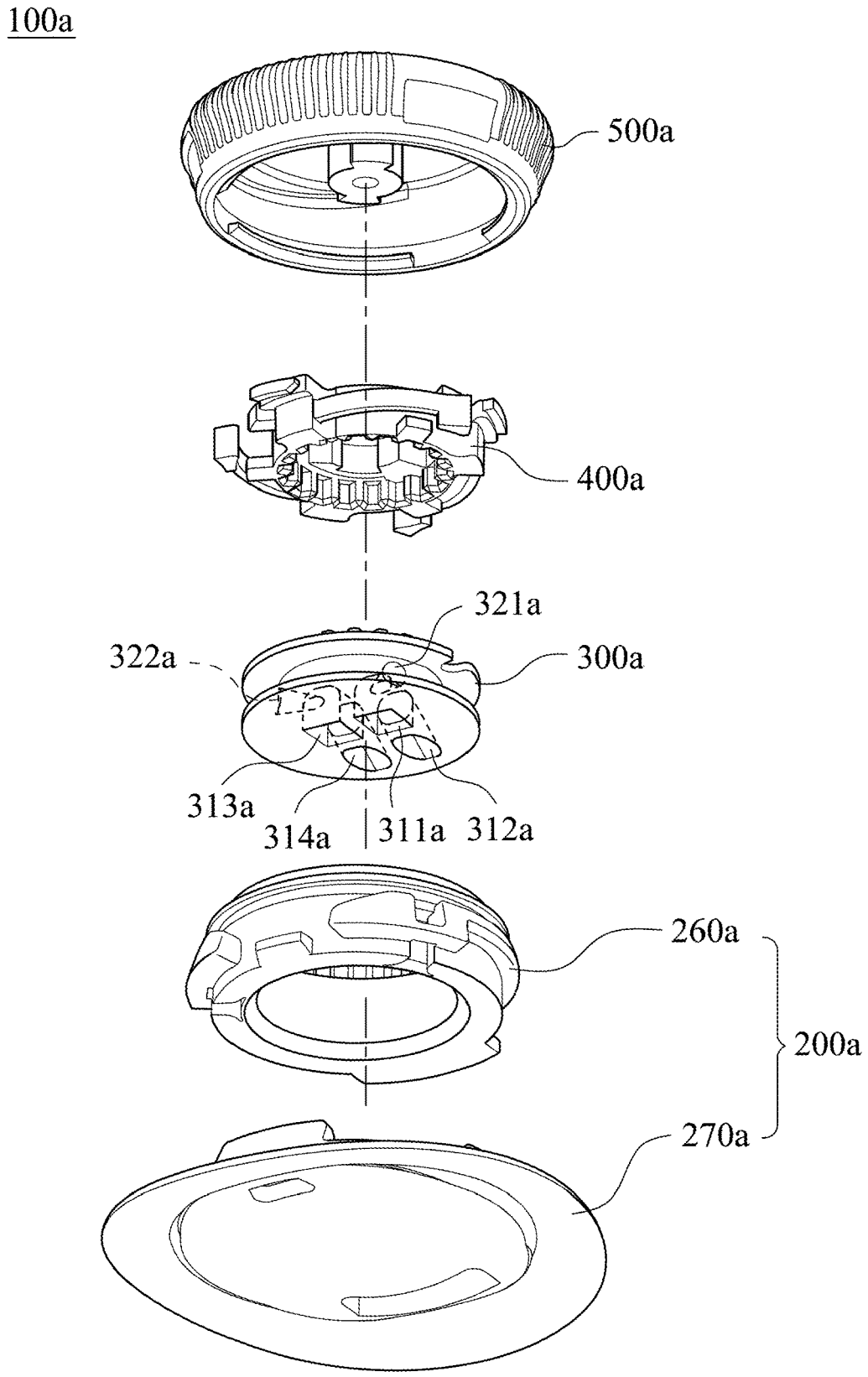
FIG. 7A shows one exploded view of the fastening device of FIG. 6.
Figure 7B:
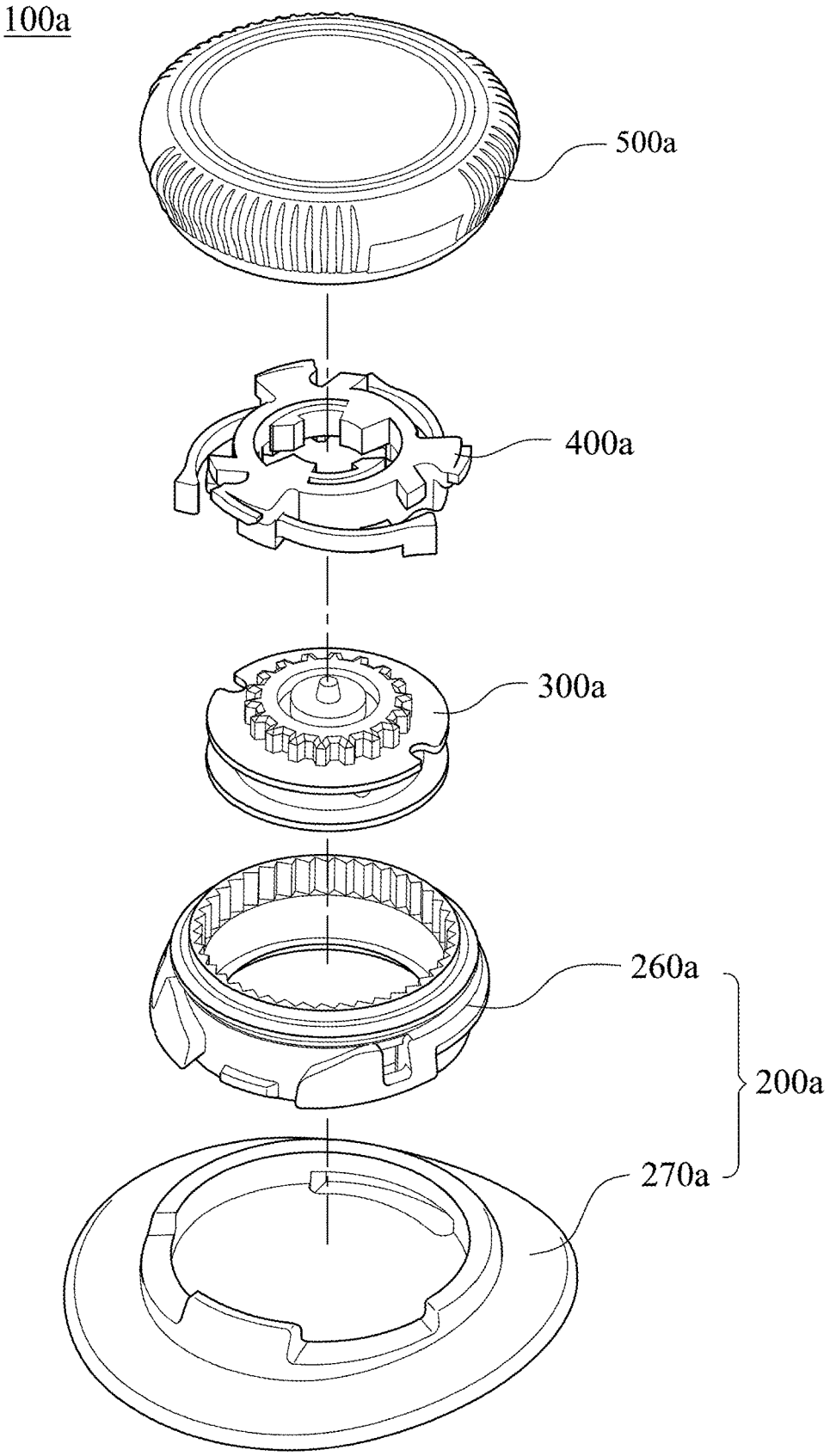
FIG. 7B shows another exploded view of the fastening device of FIG. 6.

Please refer to FIG. 6, FIG. 7A and FIG. 7B, wherein FIG. 6 shows a three dimensional schematic view of a fastening device 100*a* according to a 2nd embodiment of the present disclosure, FIG. 7A shows one exploded view of the fastening device 100*a* of FIG. 6, and FIG. 7B shows another exploded view of the fastening device 100*a* of FIG. 6.

The fastening device 100*a* is for loosening and tightening a lace (not shown) and is composed of a case 200*a*, a spool 300*a*, a knob 500*a* and a locking unit 400*a*, the structures and operations of the case 200*a*, the spool 300*a*, the knob 500*a* and the locking unit 400*a* are similar to the structures of the case 200, the spool 300, the knob 500 and the locking unit 400 of FIGS. 1 to 5B, but the difference is, the relationships between the first opening 321*a*, the second opening 322*a*, the first knotting hole 311*a*, the first through hole 312*a*, the second knotting hole 313*a* and the second through hole 314*a* of the spool 300*a* being different from the relationships between the first opening 321, the second opening 322, the first knotting hole 311, the first through hole 312, the second knotting hole 313 and the second through hole 314. Precisely, the lace of the 2nd embodiment is coupled to the spool 300*a* with an angle of 60 degrees, and the lace of the 1st embodiment of FIG. 1 is couple to the spool 300 with an angle of 180 degrees.

Additionally, in the 2nd embodiment, the case 200*a* can further include a base 270*a* in addition to the housing 260*a*, after coupling the lace to the spool 300*a* as shown in FIGS. 3A to 3C, the base 270*a* can coupled to the housing 260*a*, serving as a protection function.

Figure 8A:
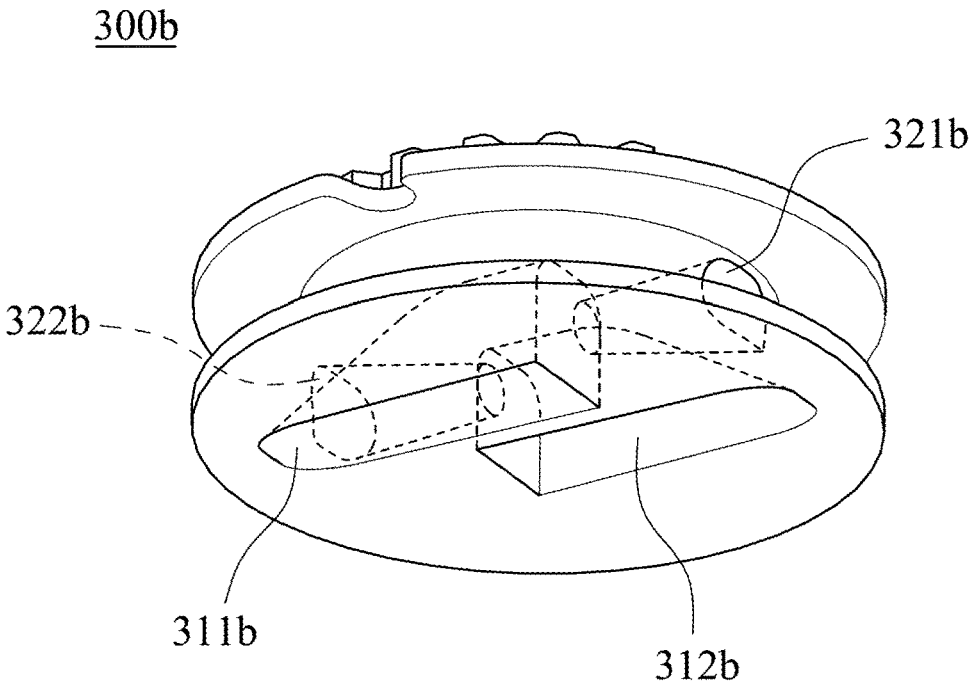
FIG. 8A shows a three dimensional schematic view of a spool of a fastening device according to a 3rd embodiment of the present disclosure.
Figure 8B:
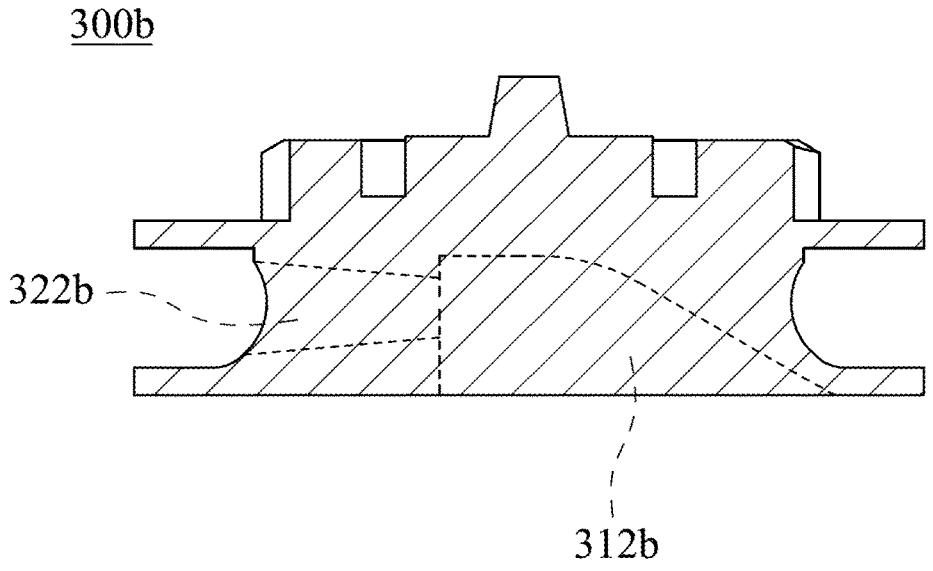
FIG. 8B shows a cross-sectional view of the spool of FIG. 8A.

Please refer to FIG. 8A and FIG. 8B, wherein FIG. 8A shows a three dimensional schematic view of a spool 300*b* of a fastening device according to a 3rd embodiment of the present disclosure, and FIG. 8B shows a cross-sectional view of the spool 300*b* of FIG. 8B. In the 3rd embodiment, the basic structure of the fastening device is similar to the structure of the fastening device 100*a*, but the structure of the spool 300*a* is different, thus only the spool 300*b* is shown, while the other elements of the fastening device are omitted.

The spool 300*b* is disc-shaped, and includes a spool cylinder (not labeled) and a bottom (not labeled), the spool cylinder includes a first opening 321*b* and a second opening 322*b*, the bottom is for disposing the spool cylinder, and the bottom includes a first passing hole 311*b* and a second passing hole 312*b*, the first passing hole 311*b* is communicated with the first opening 321*b*, and the second opening 322*b* is communicated with the second passing hole 312*b*.

A first end (not shown) of the lace can be passed through one of the side holes, the first opening 321*b* and the first passing hole 311*b* so as to be exposed from the lower opening of the case, the user can tie the first end exposed from the lower opening into a knot and a tail, and then the knot and the tail can be limited in the first passing hole 311*b;* similarly, a second end of the lace can be passed through the other one of the side holes, the second opening 322*b* and the second passing hole 312*b* so as to be exposed from the lower opening of the case, the user can tie the second end exposed from the lower opening into another knot and another tail, and then the knot and the tail can be limited in the second passing hole 312*b*.

Figure 9:
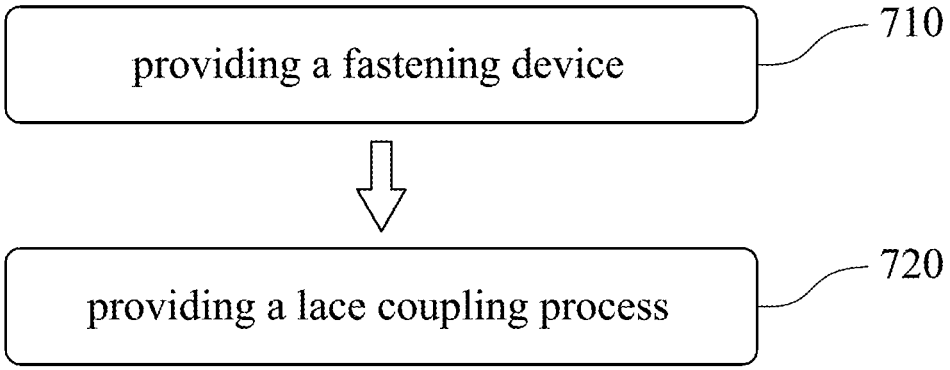
FIG. 9 shows a flow chart of a lace assembling method according to a 4th embodiment of the present disclosure.

Please refer to FIG. 9, and also refer to FIGS. 1 to 3C, wherein FIG. 9 shows a flow chart of a lace assembling method 700 according to a 4th embodiment of the present disclosure. The lace assembling method 700 includes Step 710 and Step 720.

In Step 710, a fastening device 100 is provided, as shown in FIGS. 1 to 2A, the fastening device 100 is composed of the case 200, the spool 300, the knob 500 and the locking unit 400, the case 200 includes the housing 260, the housing 260 includes the mounted portion 250, the knob 500 includes the engaged portion 540 for engaging with the mounted portion 250, the spool 300 is disposed inside the housing 260, and the locking unit 400 is coupled to the spool 300 and the knob 500.

In Step 720, a lace coupling process is provided. As shown in FIGS. 3A to 3C, the first end of the lace 600 and a second end of the lace 600 are exposed from the case 200 after passing through the case 200 and the spool 300, such that a user can knot the lace 600 to allow the lace 600 to be coupled to the spool 300. Precisely, in the lace coupling process, the first end of the lace 600 is exposed from the lowering opening 240 after passing through one of the side holes 220, the first opening 321, the first knotting hole 311 and the first through hole 312 to allow being knotted by the user, the second end of the lace 600 is exposed from the lowering opening 240 after passing through the other one of the side holes 220, the second opening 322, the second knotting hole 313 and the second through hole 314 to allow being knotted by the user, and the lace 600 can be coupled to the fastening device 100.

Figure 10:
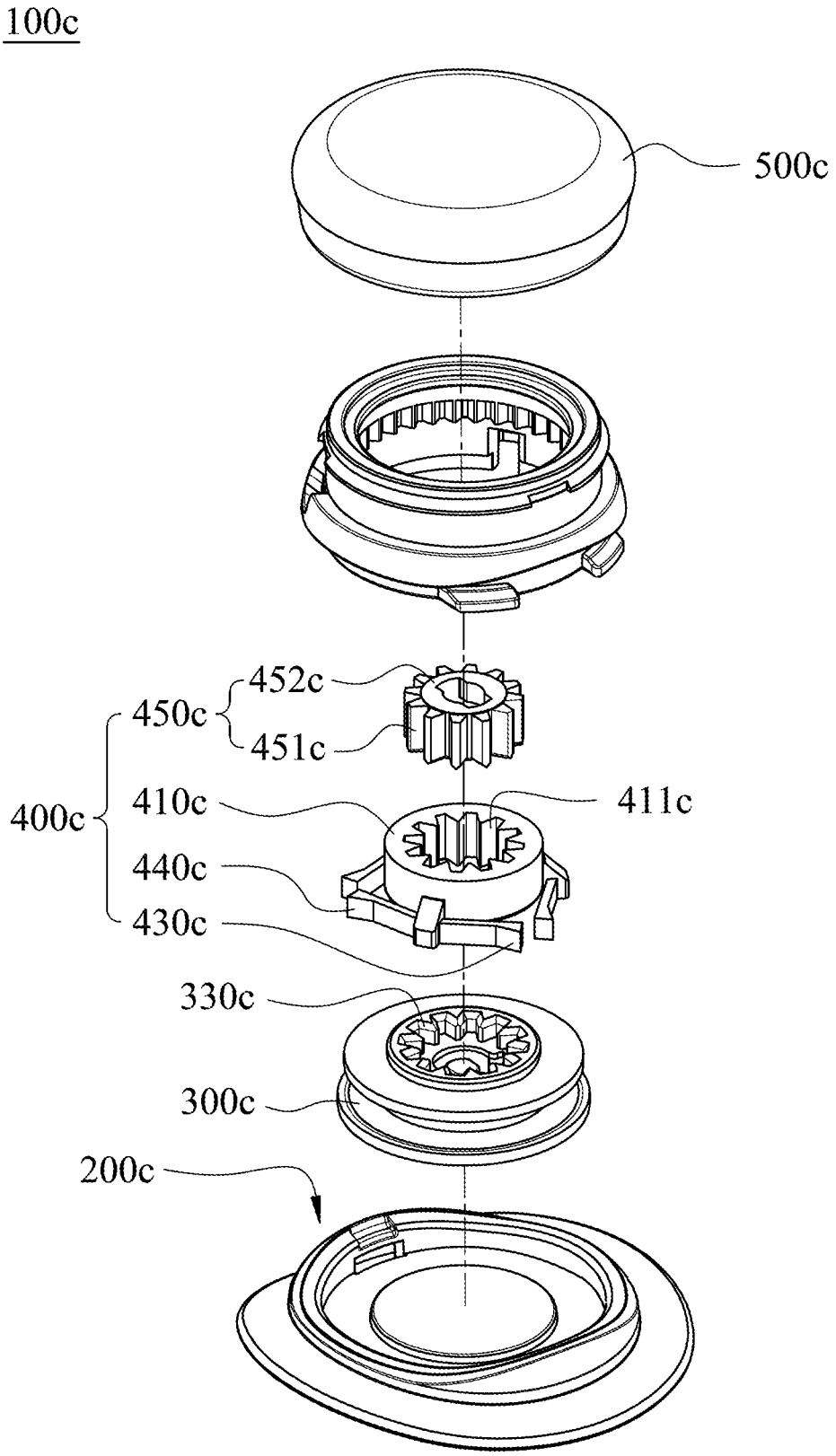
FIG. 10 shows one exploded view of a fastening device according to a 5th embodiment of the present disclosure.
Figure 11:
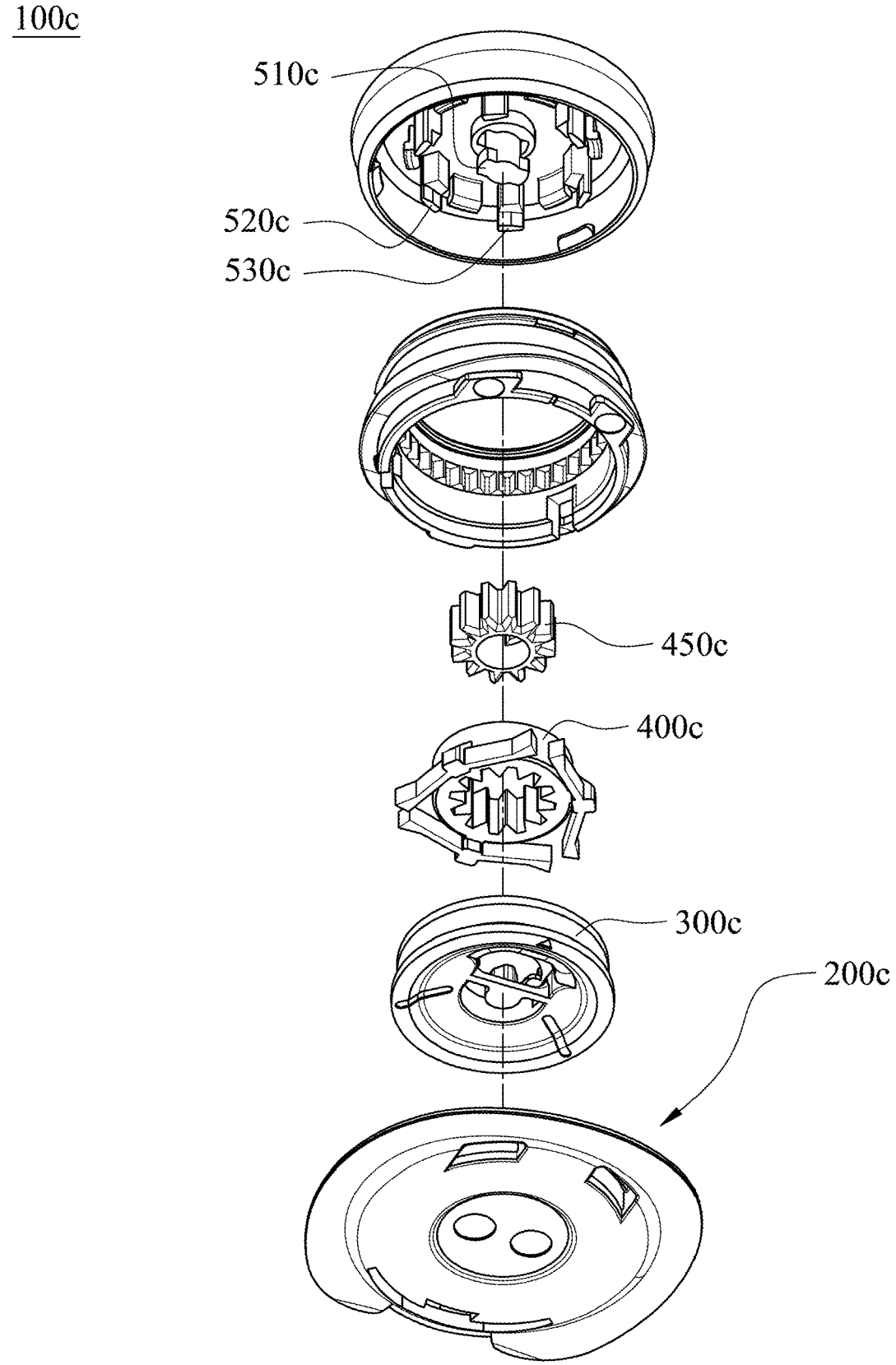
FIG. 11 shows another exploded view of the fastening device of FIG. 10.
Figure 12:
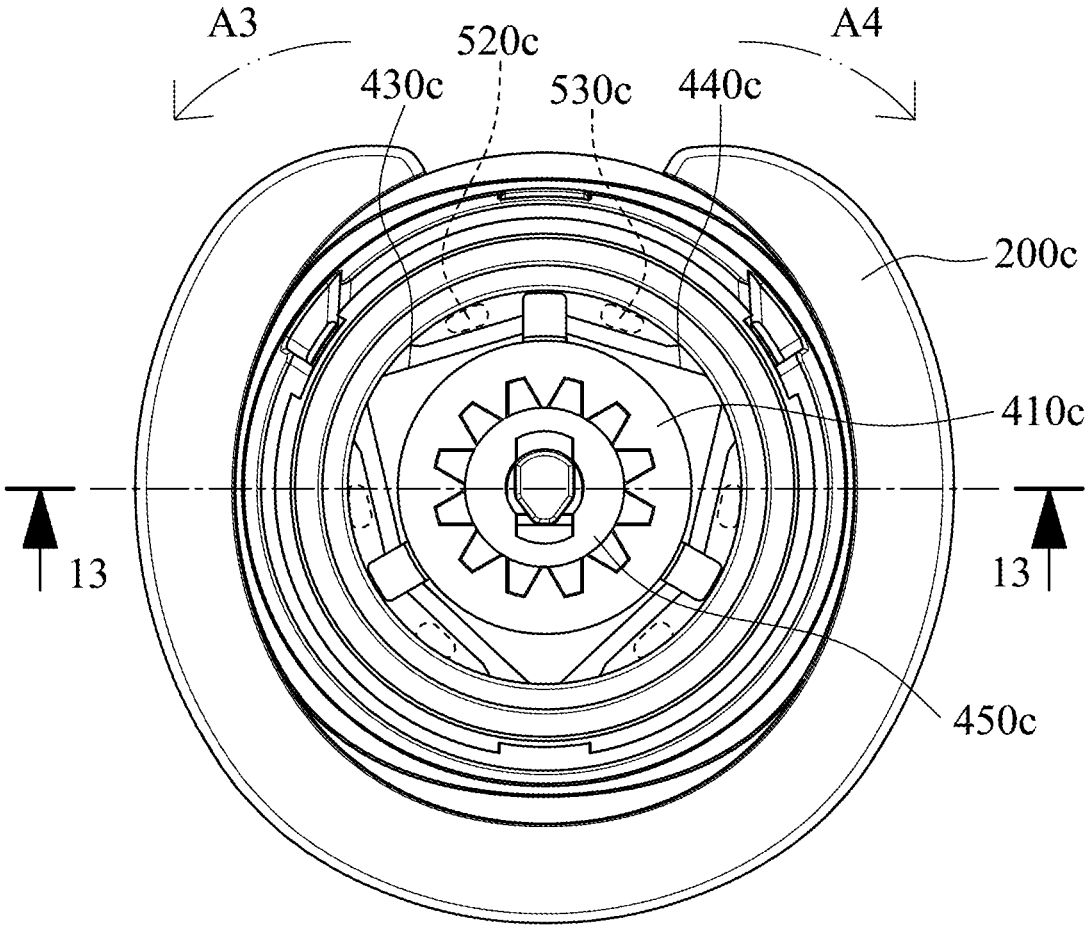
FIG. 12 shows a partial top view of the fastening device of FIG. 10.
Figure 13:
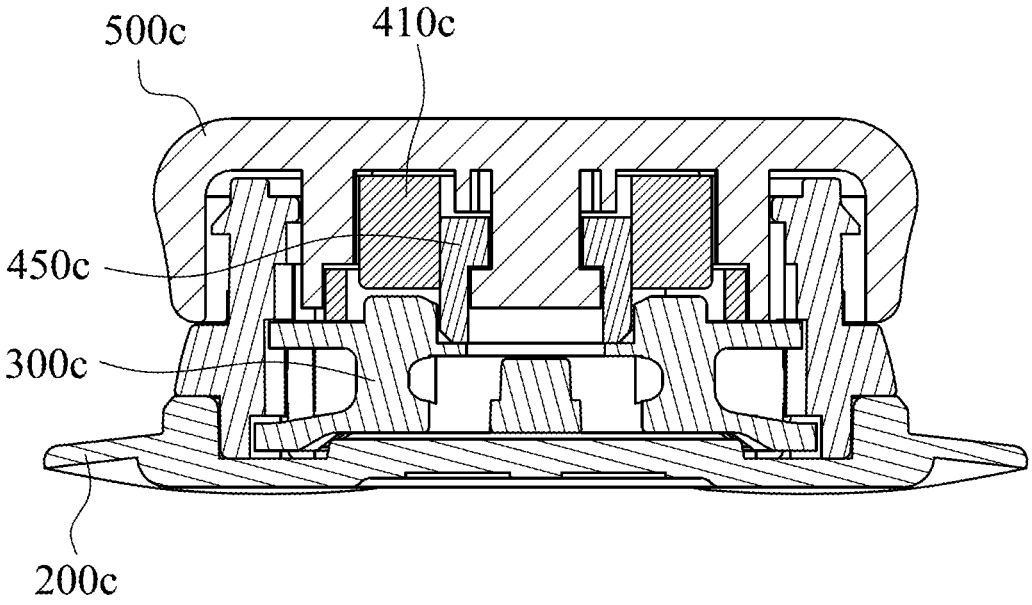
FIG. 13 shows a cross-sectional view of the fastening device of FIG. 12 taken along Line 13-13.

Please refer to FIG. 10, FIG. 11, FIG. 12 and FIG. 13. FIG. 10 shows one exploded view of a fastening device 100*c* according to a 5th embodiment of the present disclosure, FIG. 11 shows another exploded view of the fastening device 100*c* of FIG. 10, FIG. 12 shows a partial top view of the fastening device 100*c* of FIG. 10, and FIG. 13 shows a cross-sectional view of the fastening device 100*c* of FIG. 12 taken along Line 13-13. In FIG. 12, the knob 500*c* is omitted, and the first biasing protrusions 520*c* and the second biasing protrusions 530*c* are shown in dashed lines. The fastening device 100*c* includes a case 200*c,* a spool 300*c,* a locking unit 400*c* and a knob 500*c;* precisely, the fastening device 100*c* is composed of the case 200*c,* the spool 300*c,* the locking unit 400*c* and the knob 500*c*. The knob 500*c* can include a protruding column 510*c,* first biasing protrusions 520*c* and second biasing protrusions 530*c*. The locking unit 400*c* includes an engaging disc 410*c* and an inner gear 450*c*. The inner gear 450*c* is located within a central hole of the engaging disc 410*c* and includes an inserting hole 452*c* for receiving the protruding column 510*c,* and a plurality of outer teeth 451*c* for engaging with a plurality of transmission teeth 411*c* of the engaging disc 410*c* and the engaging teeth 330*c* of the spool 300*c*.

The engaging disc 410*c* further includes three first pawl arms 430*c* and three second pawl arms 440*c* extended therefrom. Each of the first biasing protrusions 520*c* is configured to displace each of the first pawl arms 430*c* in the first direction A3 to allow the spool 300*c* to incrementally fasten the lace, and each of the second biasing protrusions 530*c* is configured to displace each of the second pawl arms 440*c* in the second direction A4 to allow the spool 300*c* to incrementally release the lace. The fastening device can also be configured such that rotating the knob in the first direction can release the lace while rotating the knob in the second direction can fasten the lace.

Figure 14:
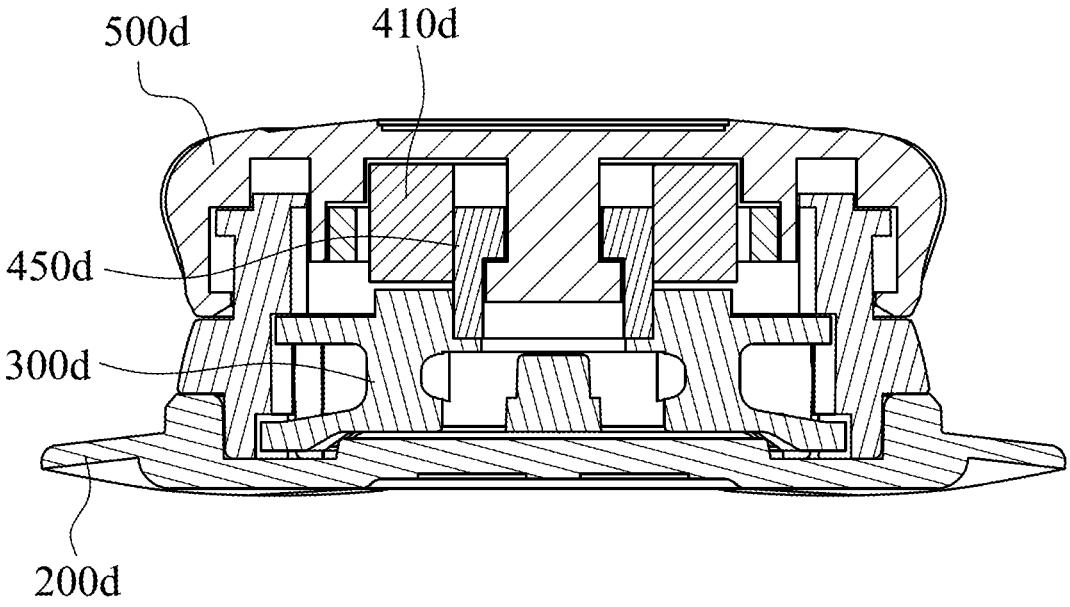
FIG. 14 shows a cross-sectional view of a fastening device according to a 6th embodiment of the present disclosure.

Please refer to FIG. 14. FIG. 14 shows a cross-sectional view of a fastening device 100*d* according to a 6th embodiment of the present disclosure. The fastening device 100*d* includes a case 200*d,* a spool 300*d,* a locking unit (not labeled) and a knob 500*d;* precisely, the fastening device 100*d* is composed of the case 200*d,* the spool 300*d,* the locking unit and the knob 500*d*. The structure of the fastening device 100*d* is similar to the structure of the fastening device 100*c*. The locking unit can also include an engaging disc 410*d* and an inner gear 450*d,* and the details will not be repeated.

Figure 15:
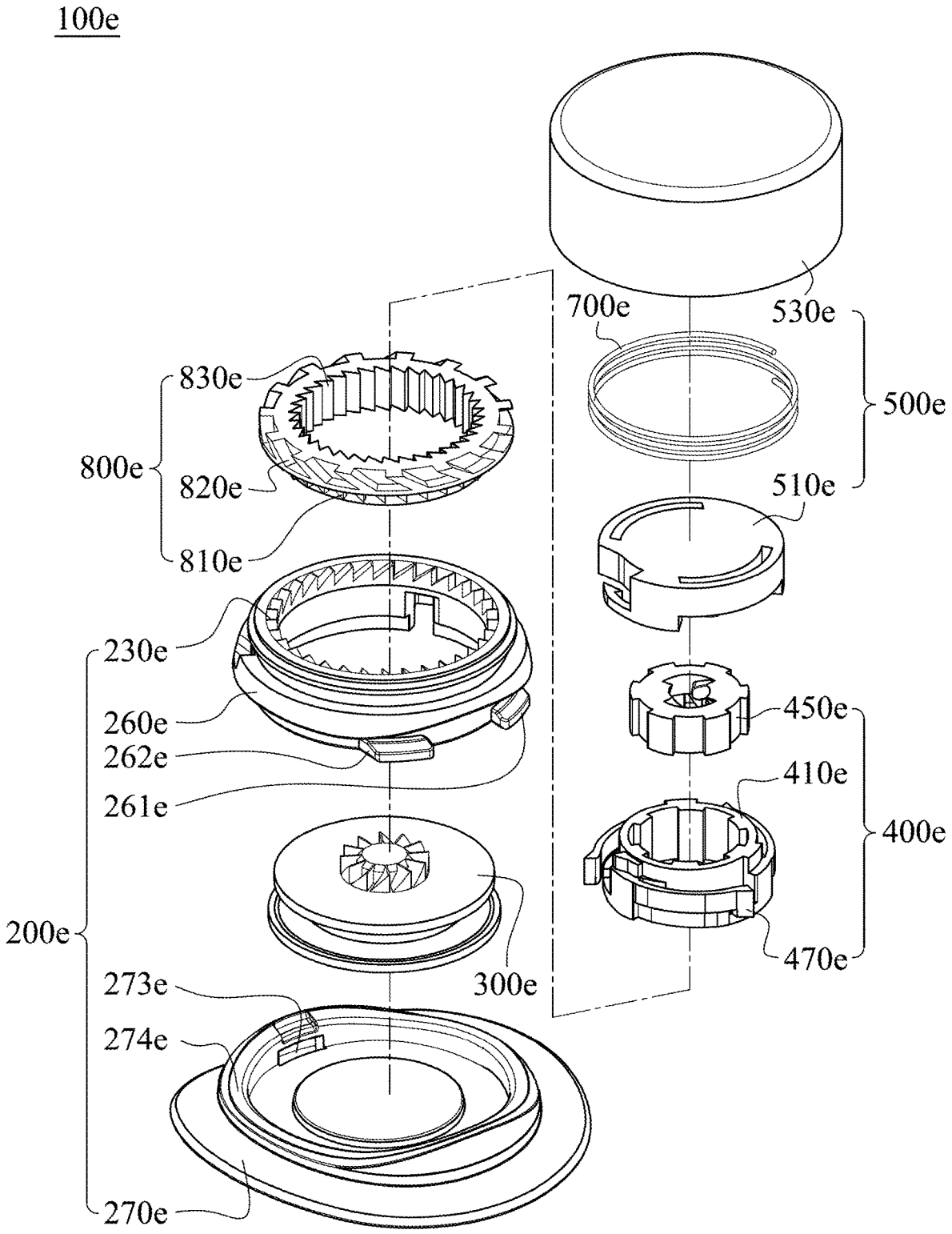
FIG. 15 shows one exploded view of a fastening device according to a 7th embodiment of the present disclosure.
Figure 16:
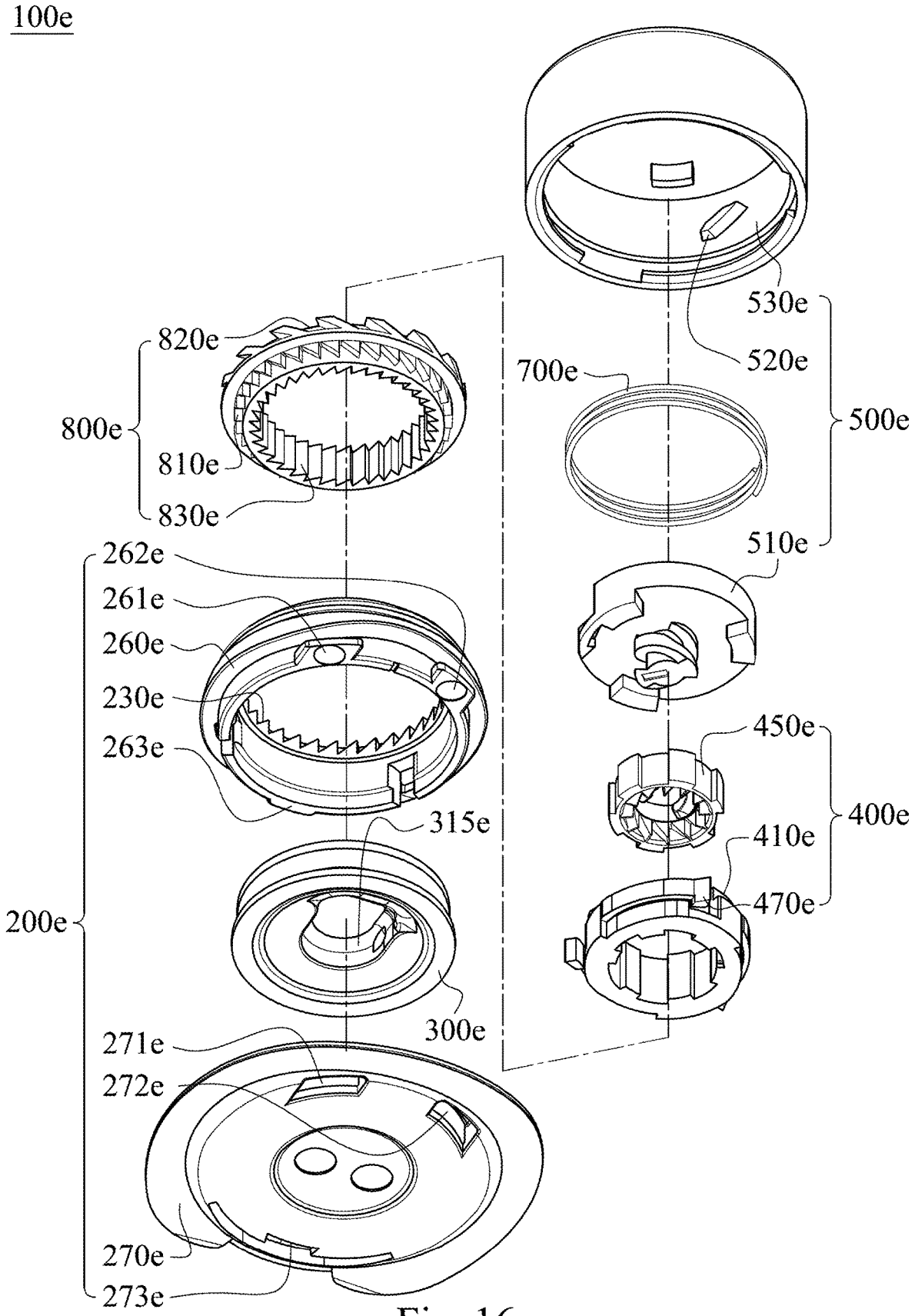
FIG. 16 shows another exploded view of the fastening device of FIG. 15.
Figure 17:
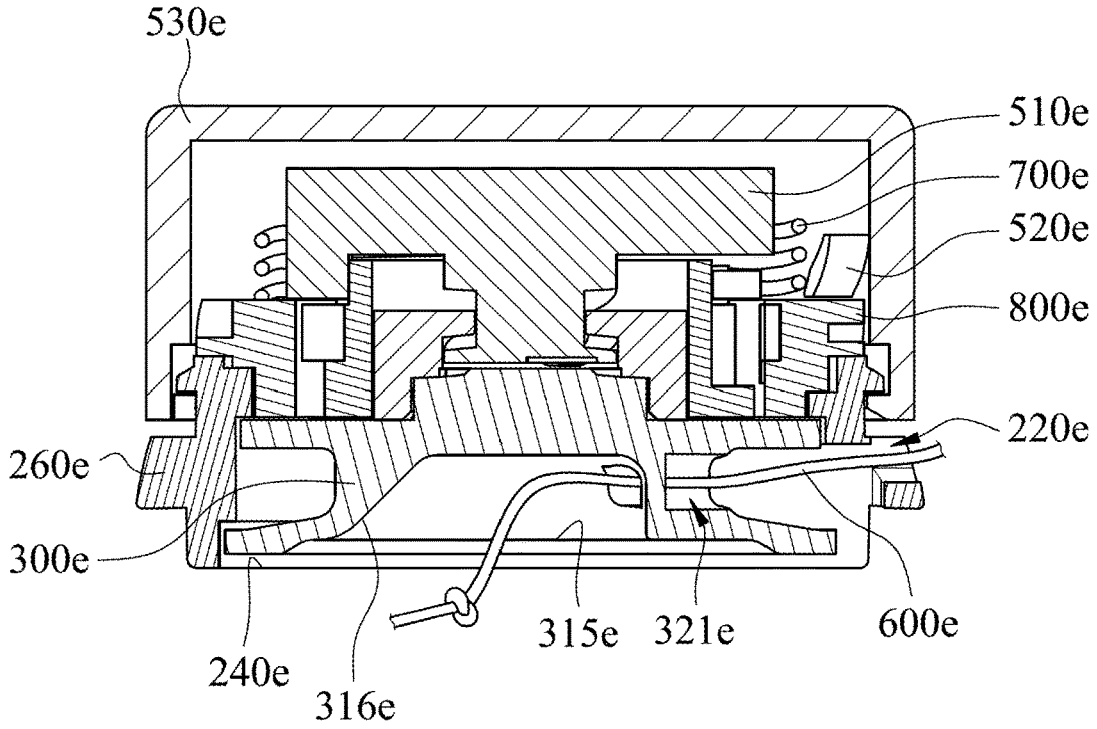
FIG. 17 shows a cross-sectional view of the fastening device of FIG. 15.

Please refer to FIG. 15, FIG. 16 and FIG. 17, FIG. 15 shows one exploded view of a fastening device 100*e* according to a 7th embodiment of the present disclosure, FIG. 16 shows another exploded view of the fastening device 100*e* of FIG. 15, FIG. 17 shows a cross-sectional view of the fastening device 100*e* of FIG. 15, and the base 270*e* is omitted in FIG. 17 for clear illustration. The fastening device 100*e* includes a case 200*e,* a spool 300*e,* a locking unit 400*e,* a knob 500*e,* a ratchet ring 800*e* and a spring 700*e*.

The case 200*e* includes a base 270*e* and a housing 260*e*. The housing 260*e* includes three tabs 261*e,* 262*e* and 263*e* correspondent to the holes 271*e,* 272*e* and 273*e,* respectively. The housing 260*e* can further include a continuous wall 274*e*.

The ratchet ring 800*e* is disposed in the housing 260*e*. The ratchet ring 800*e* includes a plurality of lower sloped teeth 810*e* corresponding to the inner teeth 230*e* on the housing 260*e,* a plurality of upper sloped grooves 820*e* and a plurality of ratchet teeth 830*e*. The locking unit 400*e* includes an engaging disc 410*e,* an inner gear 450*e* and three pawl arms 470*e* corresponding to the ratchet teeth 830*e*. The knob 500*e* includes a rotary cover 530*e* and an inner plate 510*e*. The inner plate 510*e* is coupled to the rotary cover 530*e* and is selectively engaged with the engaging disc 410*e*. A spring 700*e* surrounds the inner plate 510*e* and is disposed above the ratchet ring 800*e*.

When the rotary cover 530*e* is rotated in the tightening direction, the pawl arms 470*e* is disengaged from the ratchet teeth 830*e* to allow the spool 300*e* to fasten the lace 600*e*. On the contrary, when the rotary cover 530*e* is not pressed and is rotated in the loosening direction, the inner gear 450*e* is lifted by the inner plate 510*e* to allow the spool 300*e* to freely rotate in the loosening direction, which can fully release the lace 600*e*. Moreover, when the rotary cover 530*e* is pressed and rotated in the loosening direction simultaneously, the upper sloped groove 820*e* is guided by the guiding block 520*e* on the rotary cover 530*e,* and the ratchet ring 800*e* is lifted to disengage from the inner teeth 230*e,* which allows an incremental release of the lace 600*e*.

The spool 300*e* can include a first opening 321*e,* a second opening (not shown) and one sloped surface 316*e*. The sloped surface 316*e* faces the first opening 321*e* and the second opening. The first end of the lace 600*e* can be inserted form one of the side hole 220*e* of the housing 260*e* and the first opening 321*e* toward the sloped surface 316*e* to go into the inner region of the spool cylinder, and then can go out from the bottom opening 315*e* of the spool 300*e* and the lower opening 240*e* on the housing 260*e* to allow a user to tie the lace 600*e*. The second end of the lace 600*e* is also coupled to the spool 300*e* by the same method but is inserted into the inner region from the other one of the side hole 220*e* and the second opening of the spool 300*e*.

Figure 18:
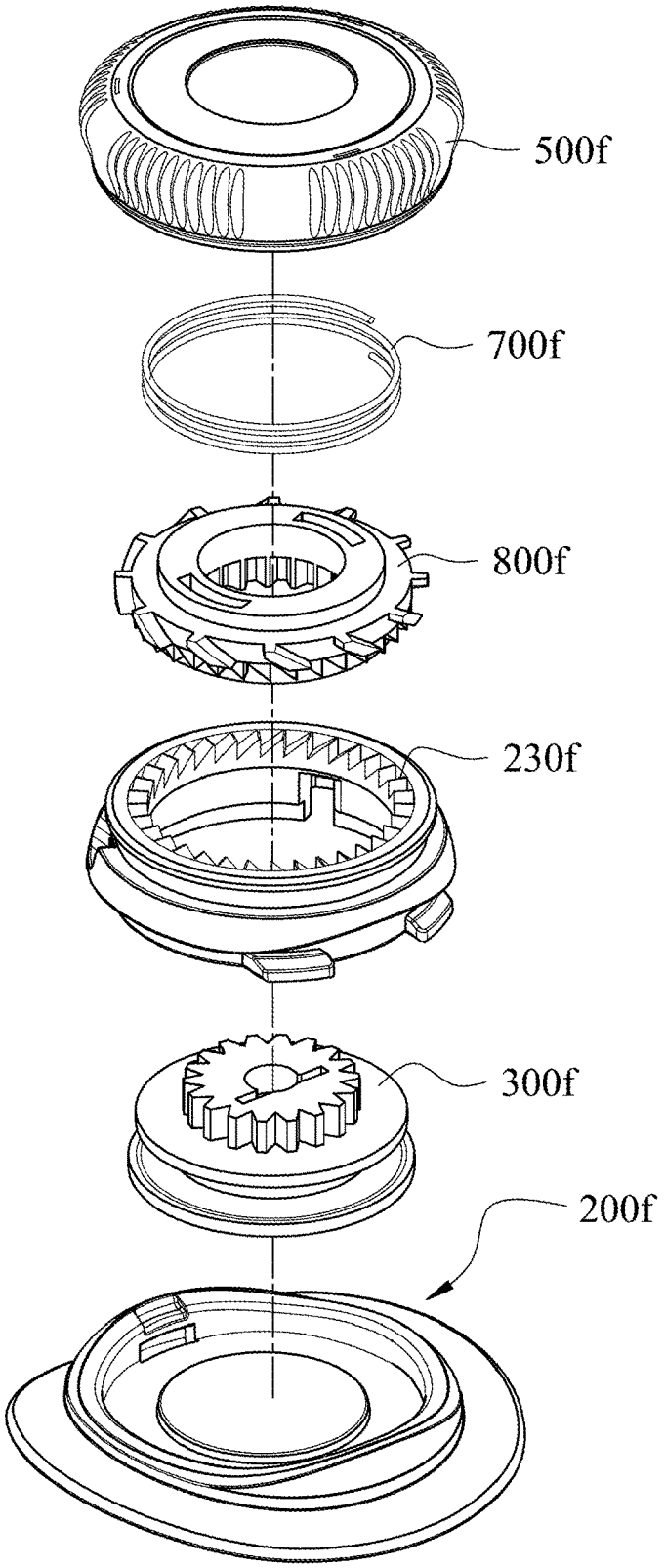
FIG. 18 shows one exploded view of a fastening device according to an 8th embodiment of the present disclosure.
Figure 19:
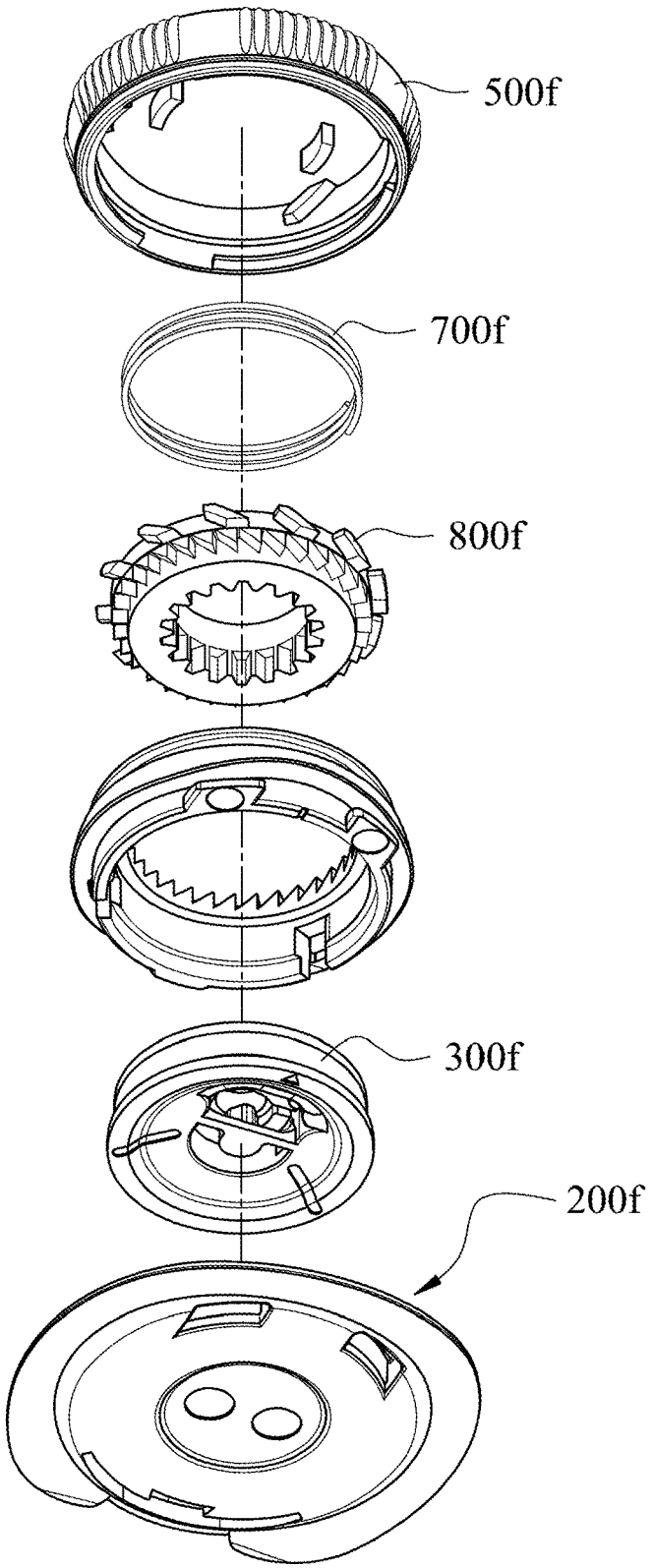
FIG. 19 shows another exploded view of the fastening device of FIG. 18.
Figure 20:
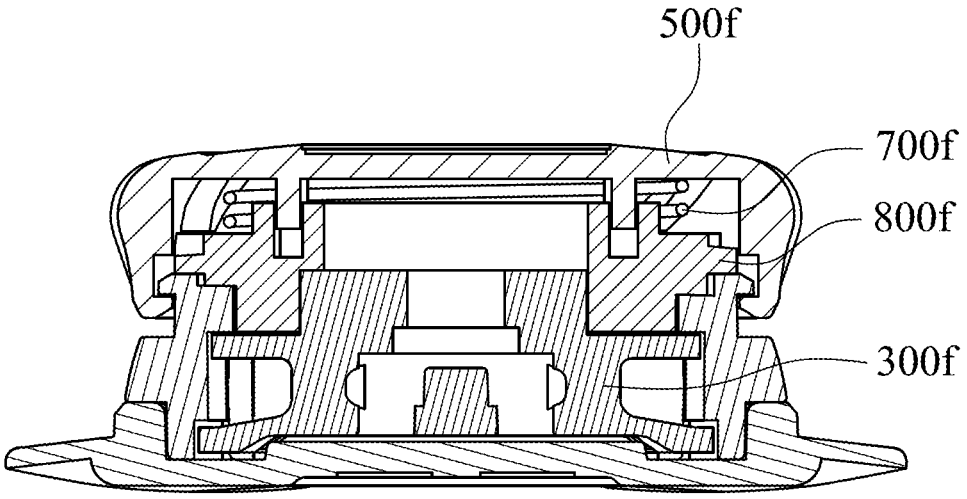
FIG. 20 shows a cross-sectional view of the fastening device of FIG. 18.

Please refer to FIG. 18, FIG. 19 and FIG. 20, FIG. 18 shows one exploded view of a fastening device 100*f* according to an 8th embodiment of the present disclosure, FIG. 19 shows another exploded view of the fastening device 100*f* of FIG. 18, and FIG. 20 shows a cross-sectional view of the fastening device 100*f* of FIG. 18. The fastening device 100*f* includes a case 200*f*, a spool 300*f*, a knob 500*f*, a ratchet ring 800*f* and a spring 700*f*.

When the knob 500*f* is rotated in the fastening direction, the ratchet ring 800*f* is continually lifted to disengage from the inner teeth 230*f*. When the knob 500*f* is pressed and rotated in the loosening direction simultaneously, the lace can be incrementally released. Hence, it is clear that the ratchet ring 800*f* functions as a locking unit which can stop or release the spool 300*f*.

Figure 21:
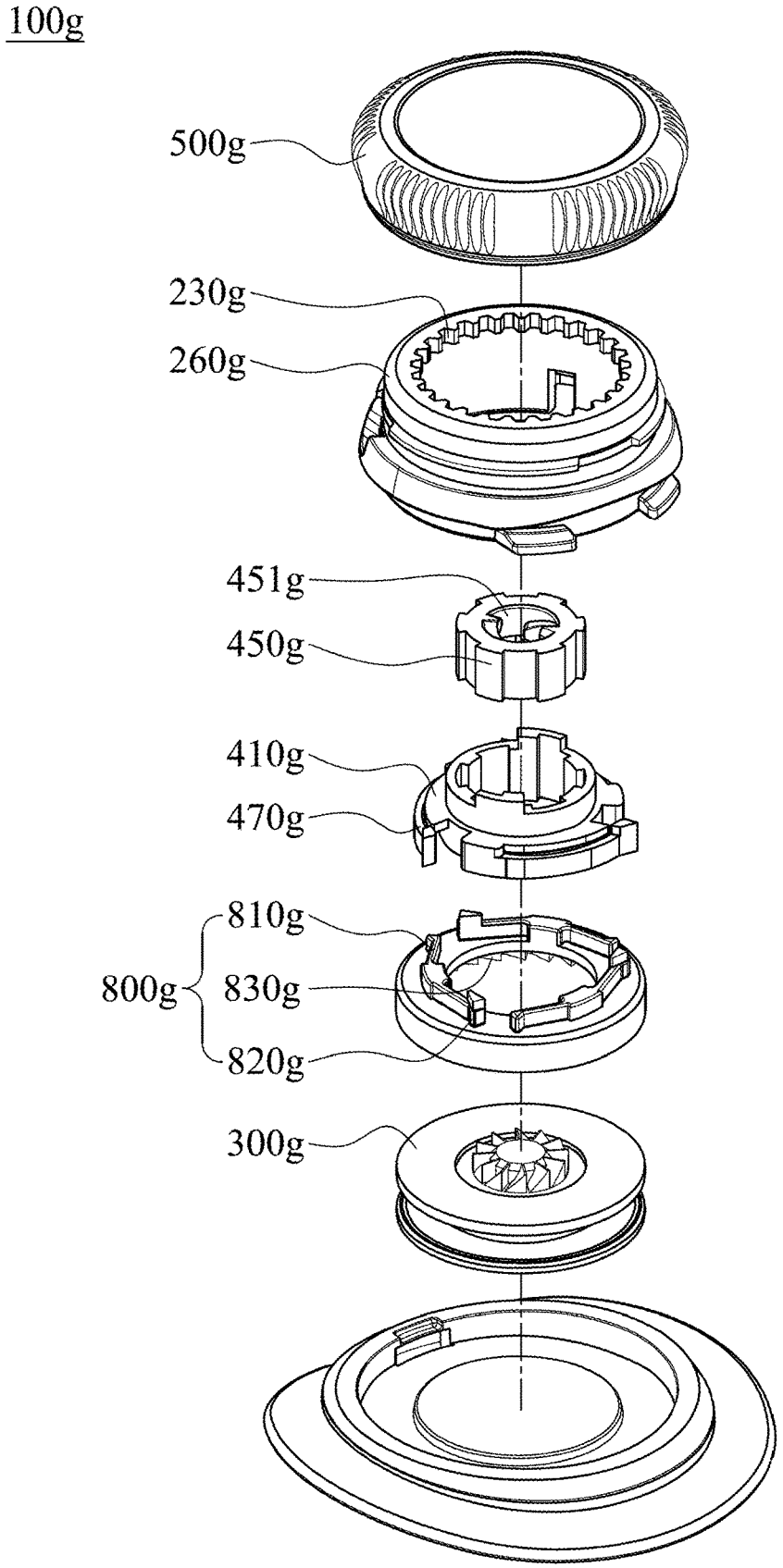
FIG. 21 shows one exploded view of a fastening device according to a 9th embodiment of the present disclosure.
Figure 22:
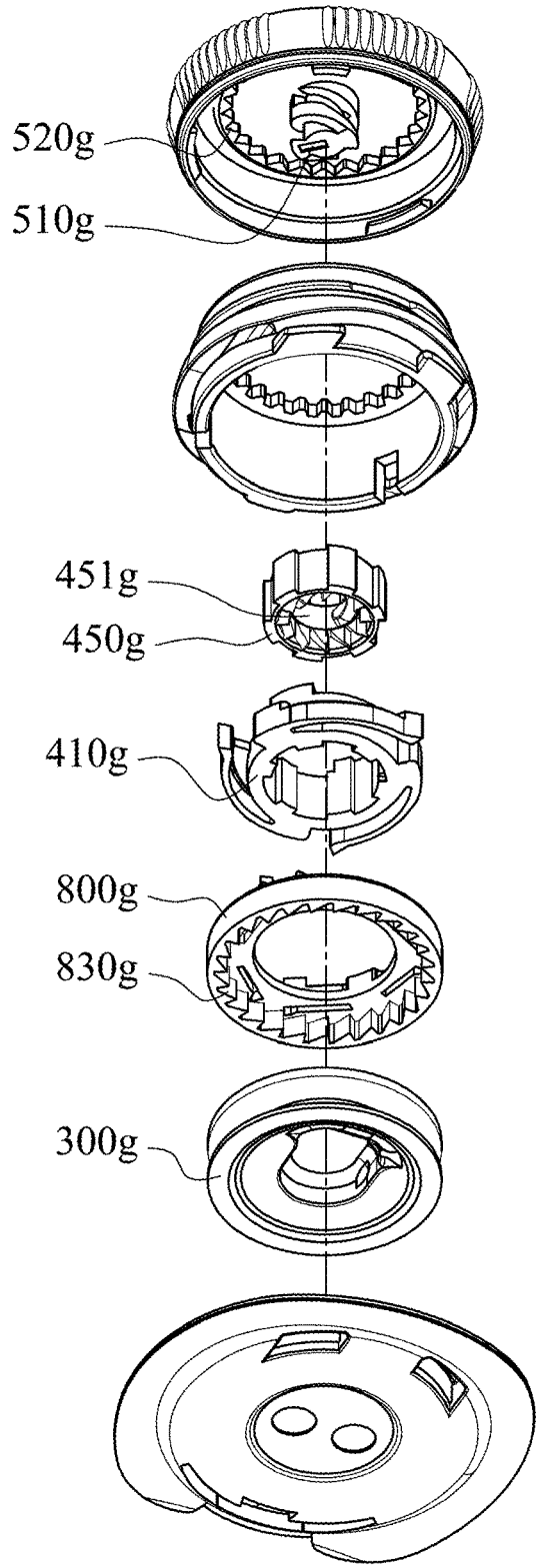
FIG. 22 shows another exploded view of the fastening device of FIG. 21.
Figure 23:
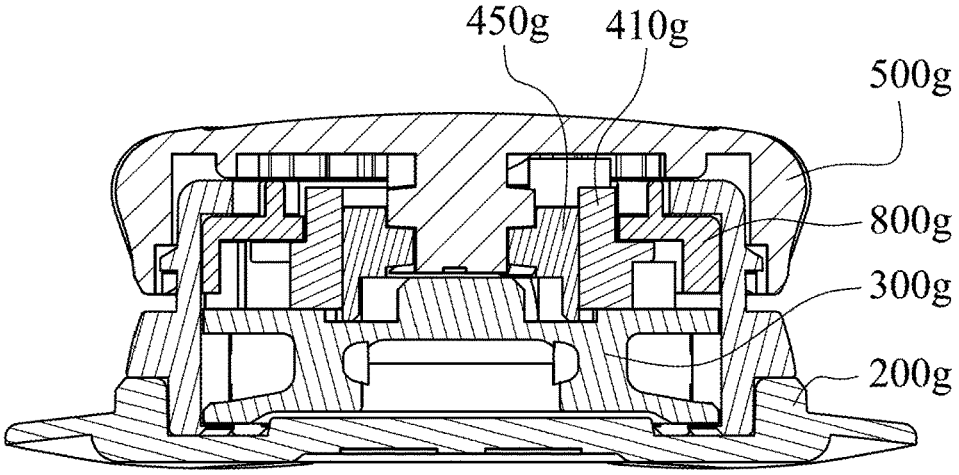
FIG. 23 shows a cross-sectional view of the fastening device of FIG. 21.

Please refer to FIG. 21, FIG. 22 and FIG. 23, FIG. 21 shows one exploded view of a fastening device 100*g* according to a 9th embodiment of the present disclosure, FIG. 22 shows another exploded view of the fastening device 100*g* of FIG. 21, and FIG. 23 shows a cross-sectional view of the fastening device 100*g* of FIG. 21. The fastening device 100*g* includes a case 200*g*, a spool 300*g*, a locking unit (not labeled), a knob 500*g* and a ratchet ring 800*g*.

The locking unit includes an engaging disc 410*g* and an inner gear 450*g* movable within the engaging disc 410*g*. The knob 500*g* includes a plurality of top teeth 520*g* and a screw post 510*g* engaged with the screw hole 451*g* of the inner gear 450*g*. The ratchet ring 800*g* includes three first arms 810*g*, three second arms 820*g* and a plurality of ratchet teeth 830*g*. The first arm 810*g* is correspondent to the inner teeth 230*g* on the housing 260*g*, and the second arm 820*g* is correspondent to both the inner teeth 230*g* and the top teeth 520*g*. The pawl arm 470*g* is selectively engaged with the ratchet teeth 830*g*.

When the knob 500*g* is forced in the tightening direction, the second arm 820*g* is disengaged from the top teeth 520*g* to allow the knob 500*g* to be rotated in the tightening direction such that the engaging disc 410*g* is driven by the knob 500*g* to cause the pawl arms 470*g* to disengage from the ratchet teeth 830*g*.

When the knob 500*g* is forced in the loosening direction, the inner gear 450*g* is lifted owing to the structure of the screw post 510*g* and the screw hole 451*g*, and the inner gear 450*g* can be separated from the spool 300*g*.

Figure 24:
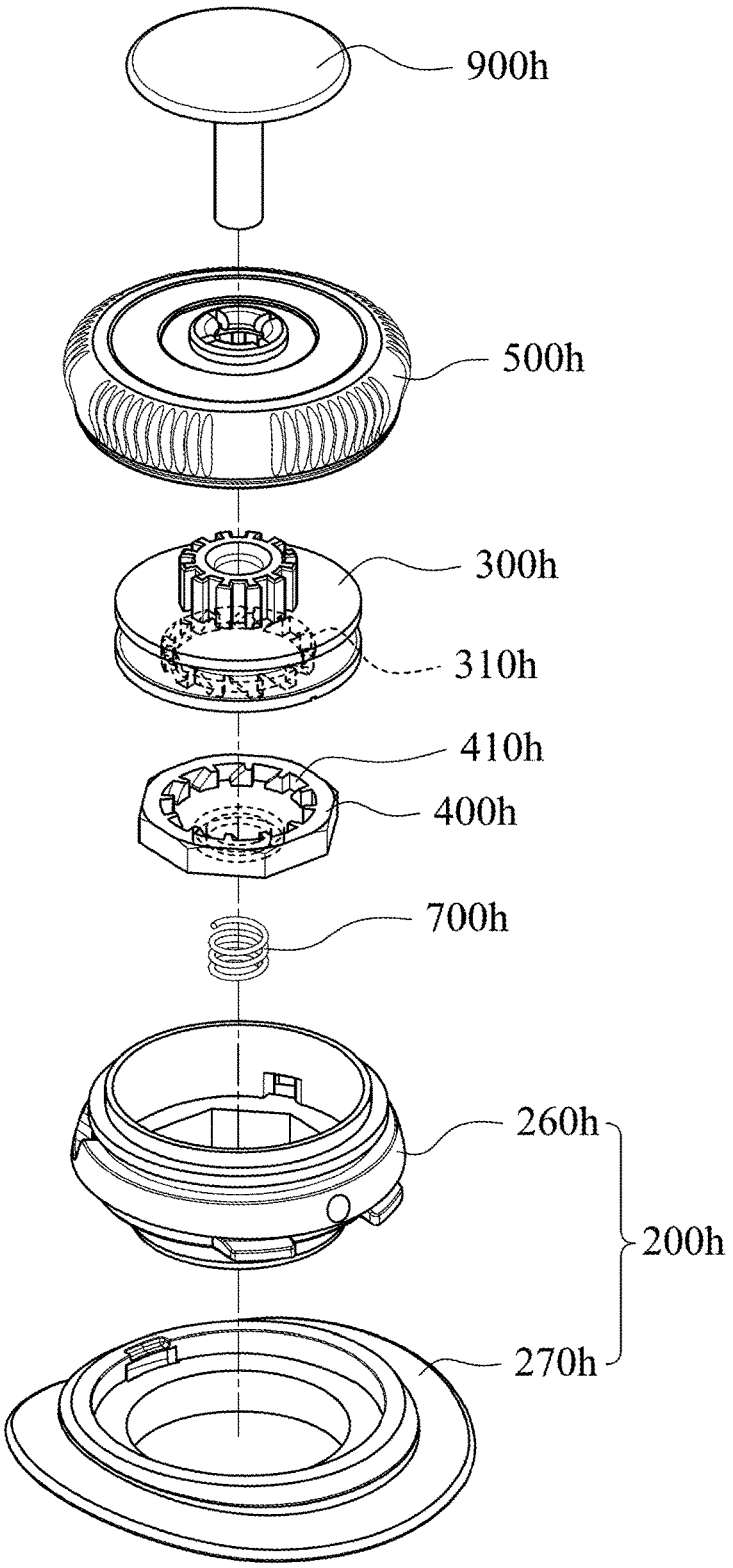
FIG. 24 shows an exploded view of a fastening device according to a 10th embodiment of the present disclosure.
Figure 25:
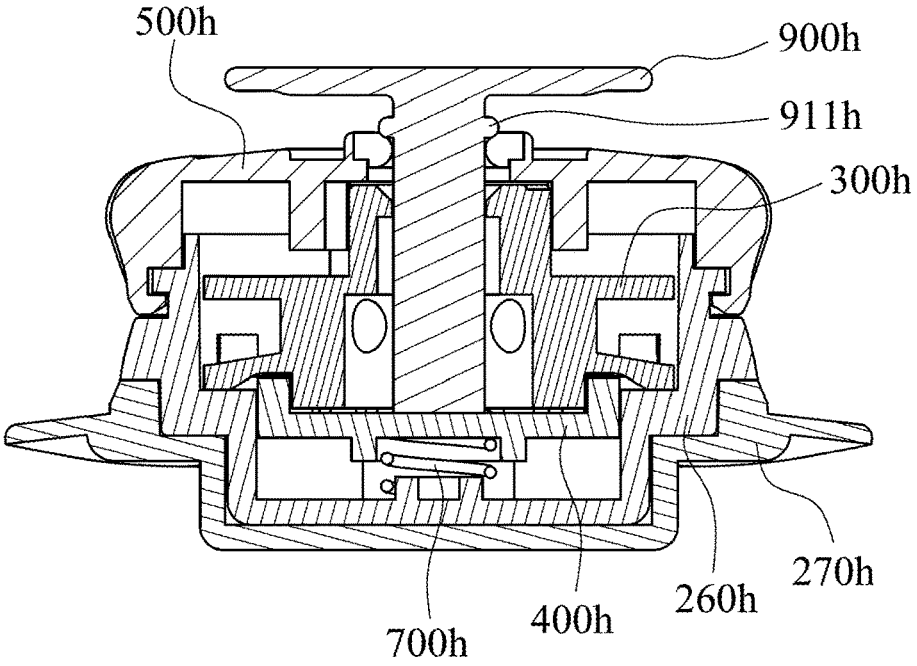
FIG. 25 shows a cross-sectional view of the fastening device of FIG. 24.

Please refer to FIG. 24 and FIG. 25, FIG. 24 shows an exploded view of a fastening device 100*h* according to a 10th embodiment of the present disclosure, and FIG. 25 shows a cross-sectional view of the fastening device 100*h* of FIG. 24. The fastening device 100*h* includes a case 200*h*, a spool 300*h*, a locking unit 400*h*, a knob 500*h*, a controlling bar 900*h* and a spring 700*h*.

The controlling bar 900*h* is movably inserted in the knob 500*h*. The spool 300*h* coupling to the knob 500*h* includes a plurality of first pawl teeth 310*h*. The locking unit 400*h* includes a plurality of second pawl teeth 410*h* selectively engaged with the first pawl teeth 310*h*. The spring 700*h* is abutted between the housing 260*h* and the base 270*h*.

When the controlling bar 900*h* is in the fastening position with the flange 911*h* located above the knob 500*h*, the spring 700*h* is not compressed, and the second pawl teeth 410*h* are engaged with the first pawl teeth 310*h* in the loosening direction. When the controlling bar 900*h* is pressed downward and switched to the releasing position with the flange 911*h* located below the top of knob 500*h*, the spring 700*h* is compressed, and the locking unit 400*h* is separated from the spool 300*h* to allow the second pawl teeth 410*h* to be fully disengaged from the first pawl teeth 310*h* in the loosening direction.

Figure 26:
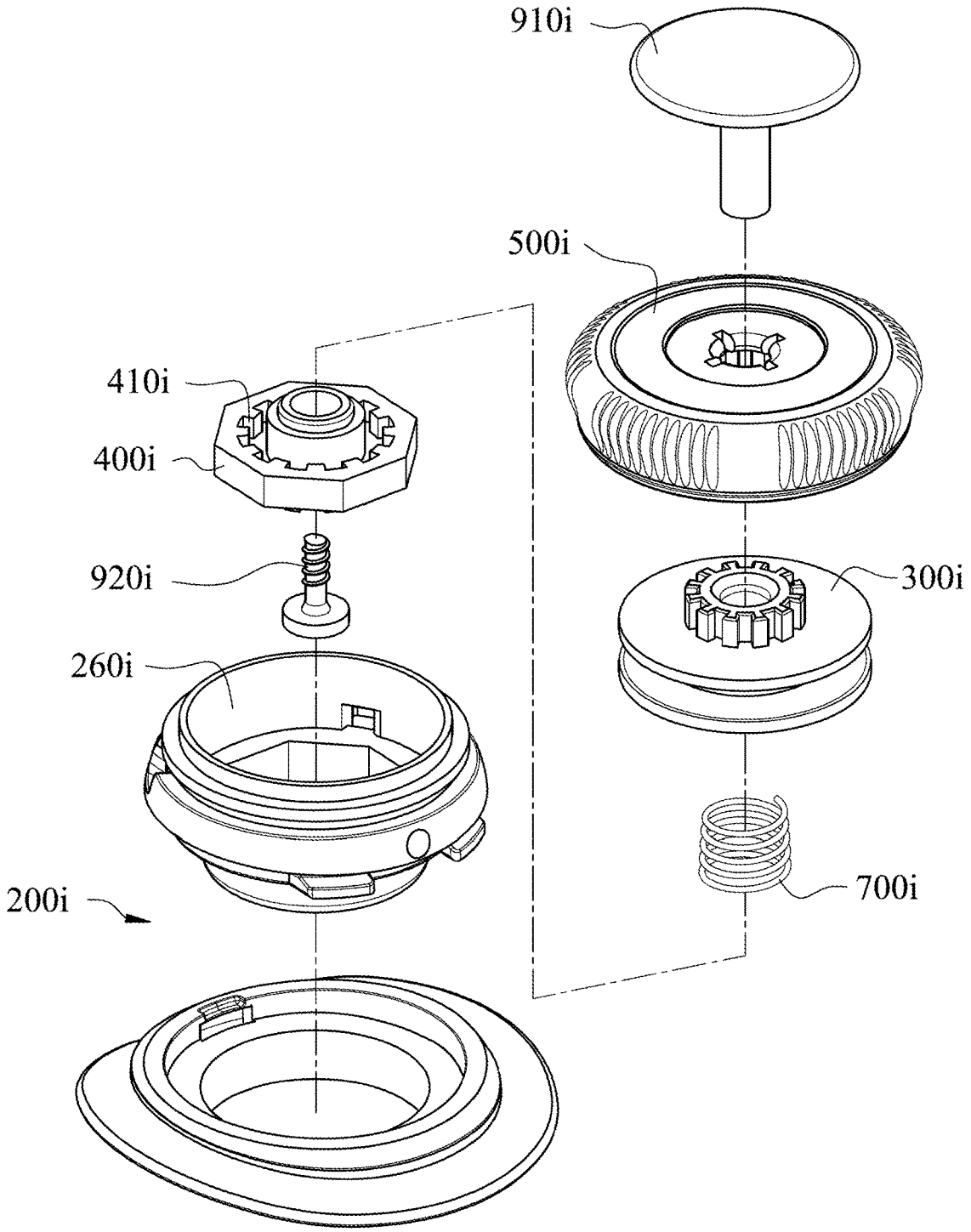
FIG. 26 shows one exploded view of a fastening device according to an 11th embodiment of the present disclosure.
Figure 27:
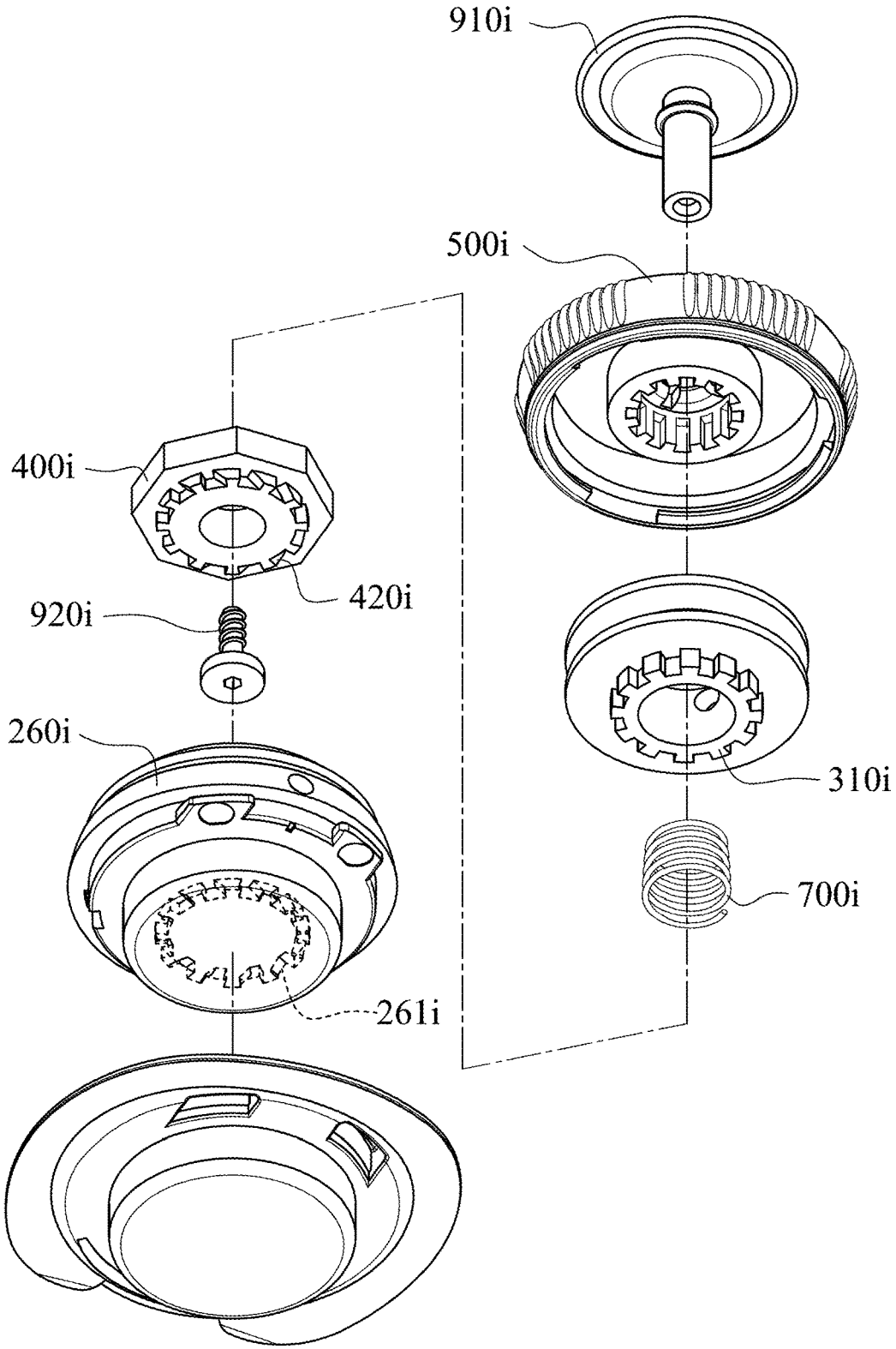
FIG. 27 shows another exploded view of the fastening device of FIG. 26.
Figure 28:
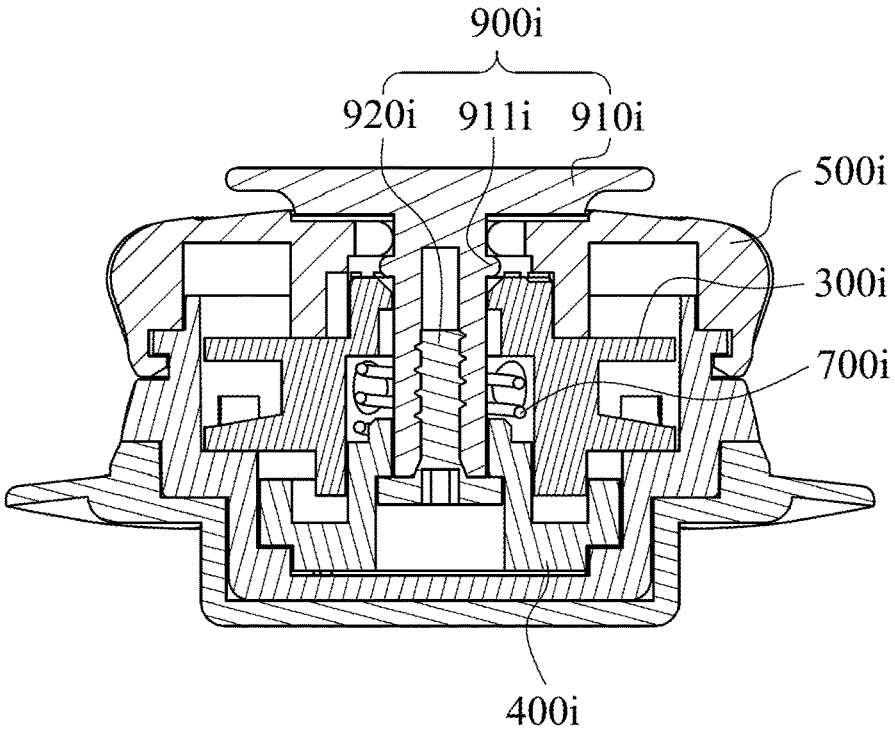
FIG. 28 shows a cross-sectional view of the fastening device of FIG. 26.

Please refer to FIG. 26, FIG. 27 and FIG. 28, FIG. 26 shows one exploded view of a fastening device 100*i* according to an 11th embodiment of the present disclosure, FIG. 27 shows another exploded view of the fastening device 100*i* of FIG. 26, and FIG. 28 shows a cross-sectional view of the fastening device 100*i* of FIG. 26. The fastening device 100*i* includes a case 200*i*, a spool 300*i*, a locking unit 400*i*, a knob 500*i*, a controlling bar set 900*i* and a spring 700*i*.

The controlling bar set 900*i* includes a controlling bar 910*i* inserted into the knob 500*i* and a screw 920*i* which is limited by the locking unit 400*i* and is screwed with the controlling bar 910*i*. The spring 700*i* sleeves the controlling bar set 900*i* and is located within the spool 300*i*. The locking unit 400*i* includes a plurality of second teeth 410*i* engaged with the first teeth 310*i* of the spool 300*i* and a plurality of first ratchet teeth 420*i* selectively engaged with the second ratchet teeth 261*i* on the housing 260*i*.

When the controlling bar set 900*i* is located in the fastening position with the flange 911*i* located below the top of the knob 500*i*, the spring 700*i* is not compressed and the locking unit 400*i* is at a lower position such that the spool 300*i* is allowed to rotate in the tightening direction while rotation in the loosening direction is not allowed. When the controlling bar set 900*i* is pulled upward to be switched to a releasing position with the flange 911*i* located above the top of the knob 500*i*, the spring 700*i* is compressed and the locking unit 400*i* is lifted to separate the first ratchet teeth 420*i* from the second ratchet teeth 261*i*, which allows a full release of the lace.

Figure 29:
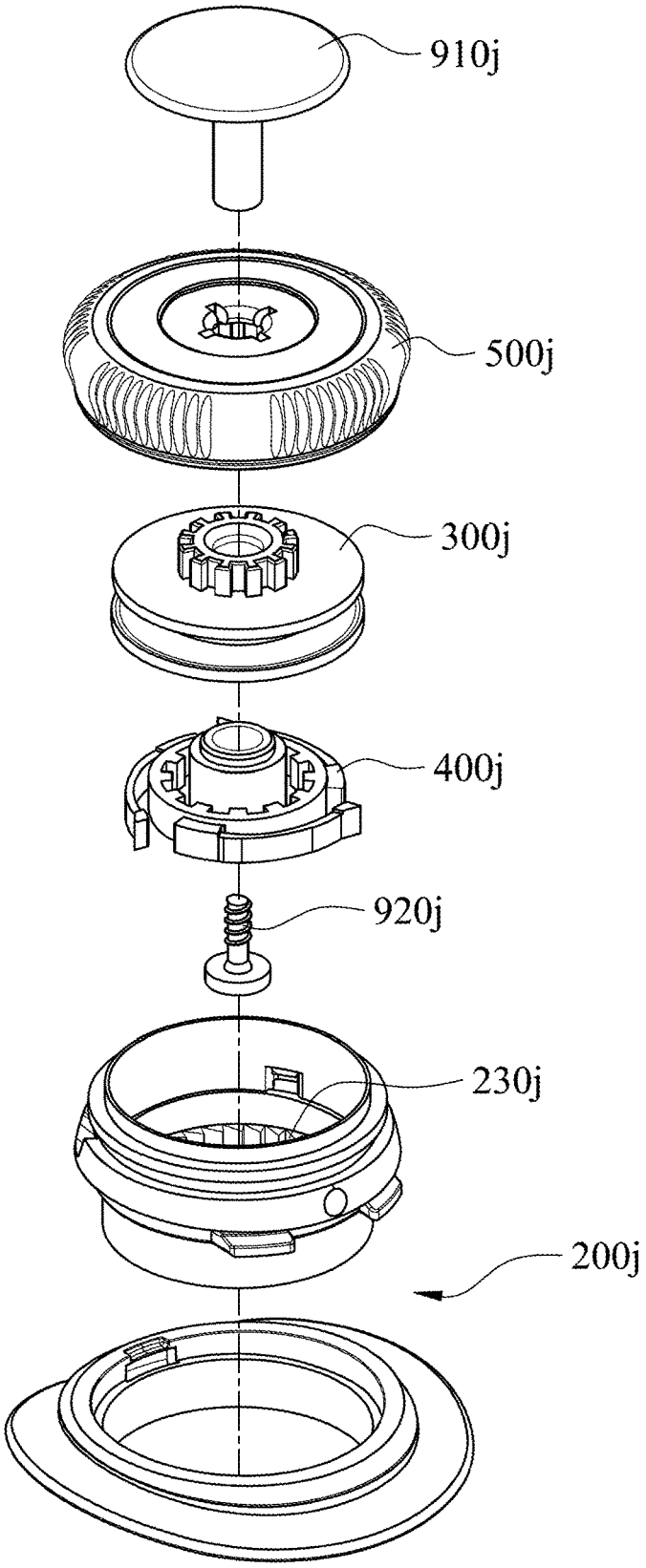
FIG. 29 shows an exploded view of a fastening device according to a 12th embodiment of the present disclosure.
Figure 30:
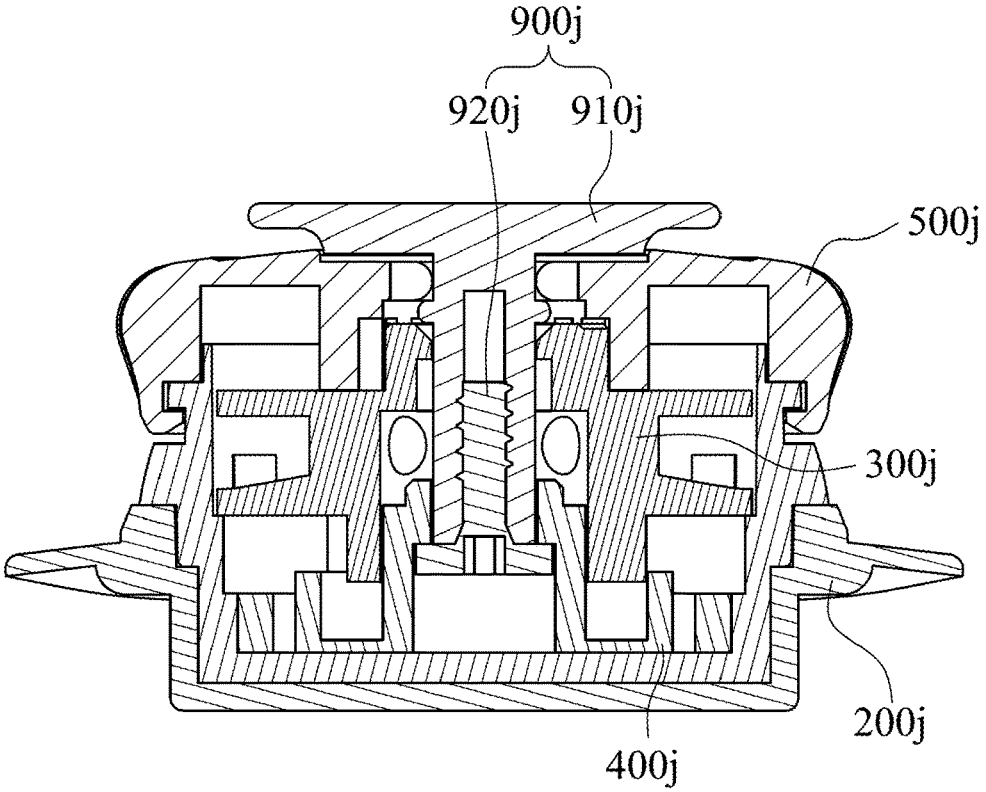
FIG. 30 shows a cross-sectional view of the fastening device of FIG. 29.

Please refer to FIG. 29 and FIG. 30, FIG. 29 shows an exploded view of a fastening device 100*j* according to a 12th embodiment of the present disclosure, and FIG. 30 shows a cross-sectional view of the fastening device 100*j* of FIG. 29. The fastening device 100*j* includes a case 200*j*, a spool 300*j*, a locking unit 400*j*, a knob 500*j*, and a controlling bar set 900*j*.

The controlling bar set 900*j* includes a controlling bar 910*j* and a screw 920*j*. When the controlling bar set 900*j* is pulled up, the locking unit 400*j* is lifted and fully separated from the inner teeth 230*j*.

Figure 31:
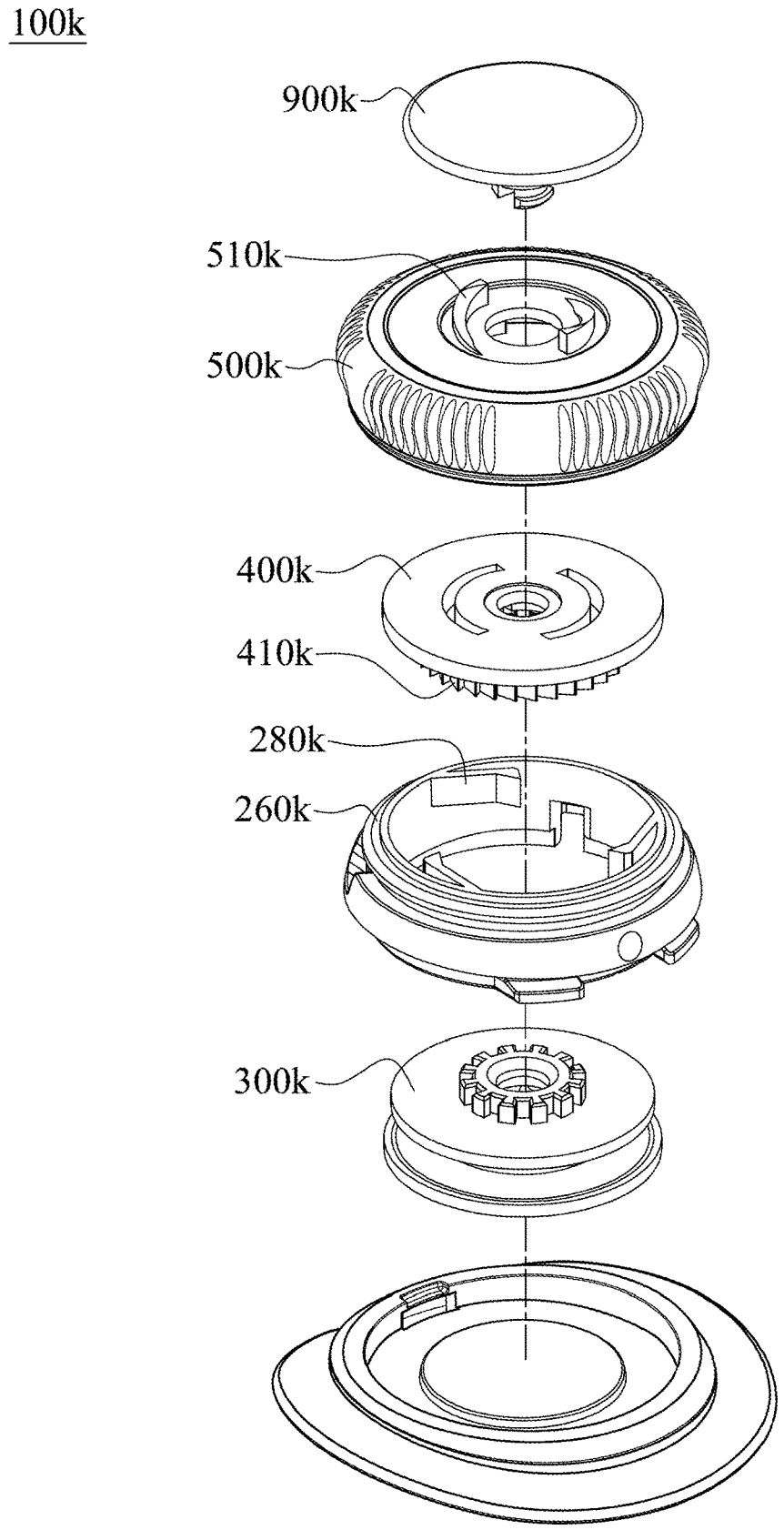
FIG. 31 shows one exploded view of a fastening device according to a 13th embodiment of the present disclosure.
Figure 32:
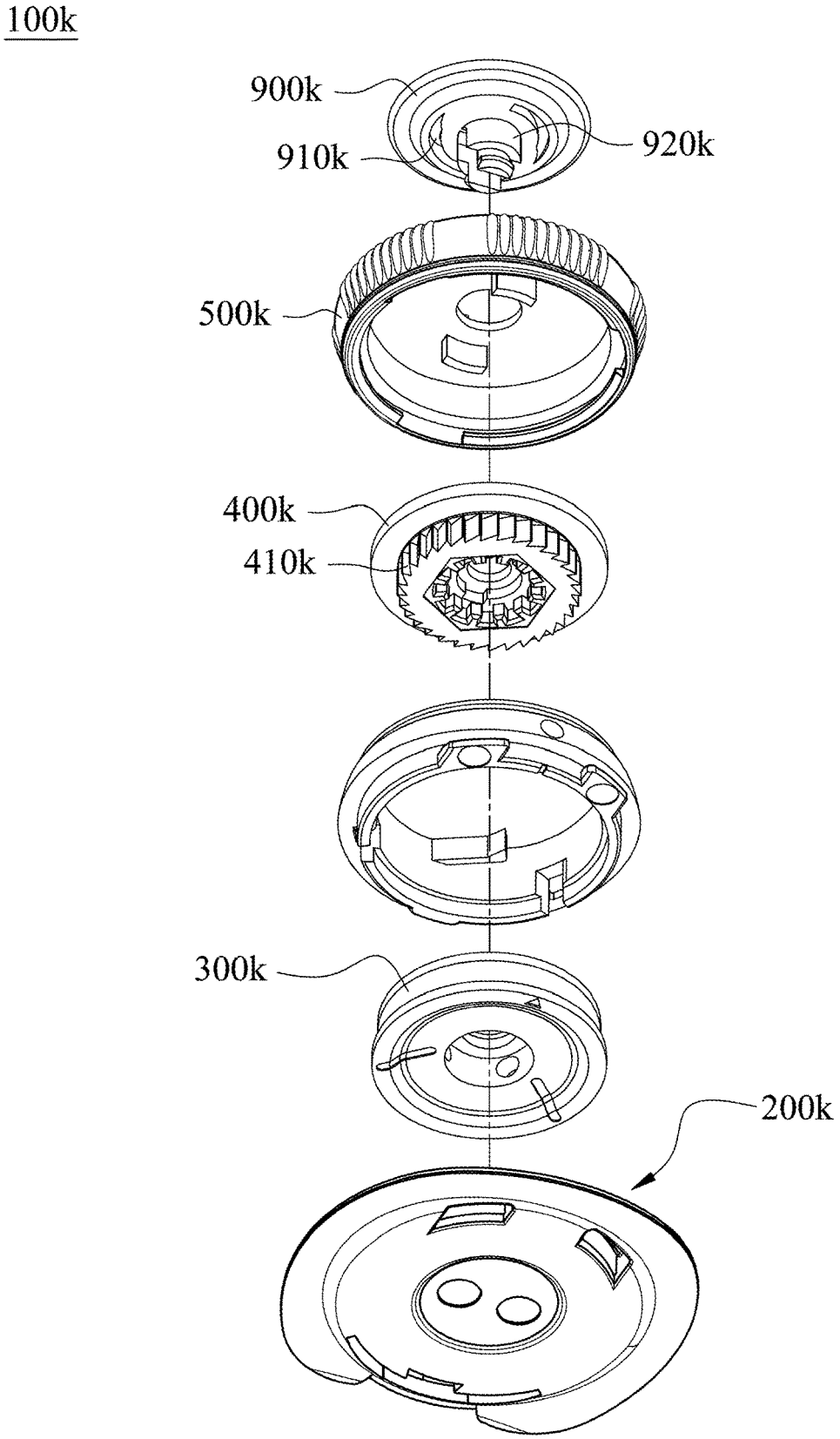
FIG. 32 shows another exploded view of the fastening device of FIG. 31.
Figure 33:
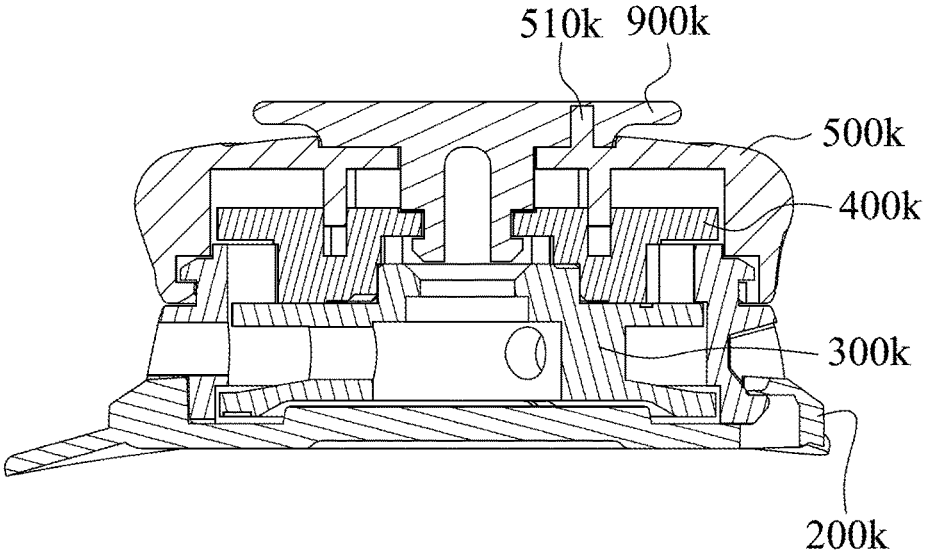
FIG. 33 shows a cross-sectional view of the fastening device of FIG. 31.

Please refer to FIG. 31, FIG. 32 and FIG. 33, FIG. 31 shows one exploded view of a fastening device 100*k* according to a 13th embodiment of the present disclosure, FIG. 32 shows another exploded view of the fastening device 100*k* of FIG. 31, and FIG. 33 shows a cross-sectional view of the fastening device 100*k* of FIG. 31. The fastening device 100*k* includes a case 200*k*, a spool 300*k*, a locking unit 400*k*, a knob 500*k*, and a controlling set 900*k*.

The knob 500*k* includes two guiding protrusions 510*k* located above a top surface of the knob 500*k*. The controlling set 900*k* includes two tracking grooves 910*k* correspondent to the two guiding protrusions 510*k*, respectively.

The locking unit 400*k* includes a plurality of bottom teeth 410*k* correspondent to the housing pawl arms 280*k* on the housing 260*k*. The locking unit 400*k* is coupled to the controlling set 900*k* by two clamping arms 920*k*. When the controlling set 900*k* is rotated relative to the knob 500*k* to switch to a higher position, the locking unit 400*k* is lifted such that the lace can be fully released.

Figure 34:
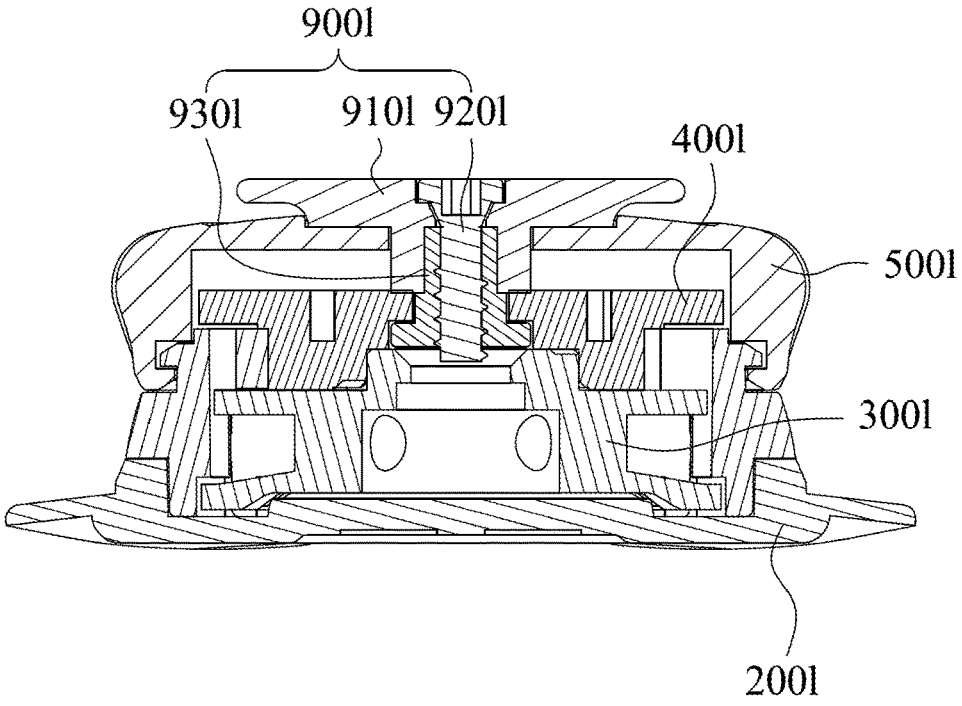
FIG. 34 shows a cross-sectional view of a fastening device according to a 14th embodiment of the present disclosure.

Please refer to FIG. 34. FIG. 34 shows a cross-sectional view of a fastening device 100*l* according to a 14th embodiment of the present disclosure. The fastening device 100*l* is similar to the fastening device 100*k* and includes a case 200*l*, a spool 300*l*, a locking unit 400*l*, a knob 500*l*, and a controlling set 900*l*, but the controlling set 900*l* is different from the controlling set 900*k*.

The controlling set 900*l* can include a restricting member 910*l*, a screw 920*l* and a barrel 930*l*. The screw 920*l* passes through the restricting member 910*l* to screw into the barrel 930*l* which is limited by the locking unit 400*l*. When the controlling set 900*l* is operated, the locking unit 400*i* is lifted. The restricting member 910*l* can include a flange similar to the flange 911*h*, but the present disclosure is not limited thereto.

Figure 35:
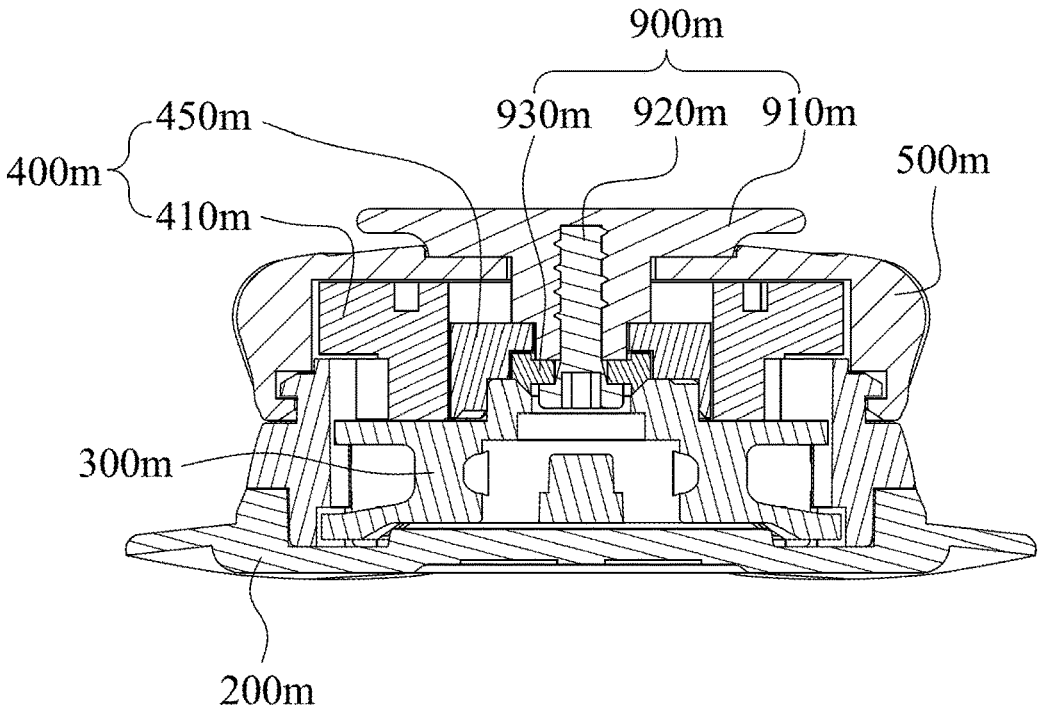
FIG. 35 shows a cross-sectional view of a fastening device according to a 15th embodiment of the present disclosure.

Please refer to FIG. 35. FIG. 35 shows a cross-sectional view of a fastening device 100*m* according to a 15th embodiment of the present disclosure. The fastening device 100*m* is similar to the fastening device 100*l* and includes a case 200*m*, a spool 300*m*, a locking unit 400*m*, a knob 500*m*, and a controlling set 900*m*, but the controlling set 900*m* and the locking unit 400*m* are different from the controlling set 900*l* and the locking unit 400*l*.

The controlling set 900*m* can include a restricting member 910*m*, a screw 920*m* and a bushing 930*m*. The screw 920*m* passes through the bushing 930*m* to screw into the restricting member 910*m*. The locking unit 400*m* includes an engaging disc 410*m* and an inner gear 450*m*, and the inner gear 450*m* is lifted by the controlling set 900*m*. The restricting member 910*m* can include a flange similar to the flange 911*h*, but the present disclosure is not limited thereto.

Figure 36:
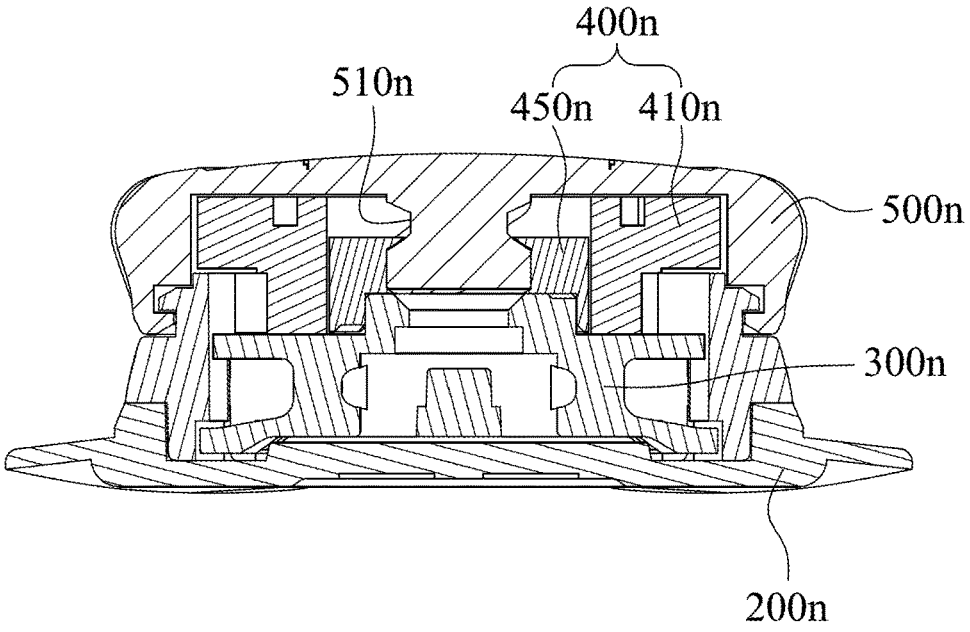
FIG. 36 shows a cross-sectional view of a fastening device according to a 16th embodiment of the present disclosure.

Please refer to FIG. 36. FIG. 36 shows a cross-sectional view of a fastening device 100*n* according to a 16th embodiment of the present disclosure. The fastening device 100*n* includes a case 200*n*, a spool 300*n*, a locking unit 400*n* and a knob 500*n*

The locking unit 400*n* includes an engaging ring 410*n* and an inner gear 450*n*, and the knob 500*n* includes a screw post 510*n* engaged with the inner gear 450*n*. When the knob 500*n* is rotated in the loosening direction, the inner gear 450*n* can be lifted to separate from the spool 300*n*.

Figure 37:
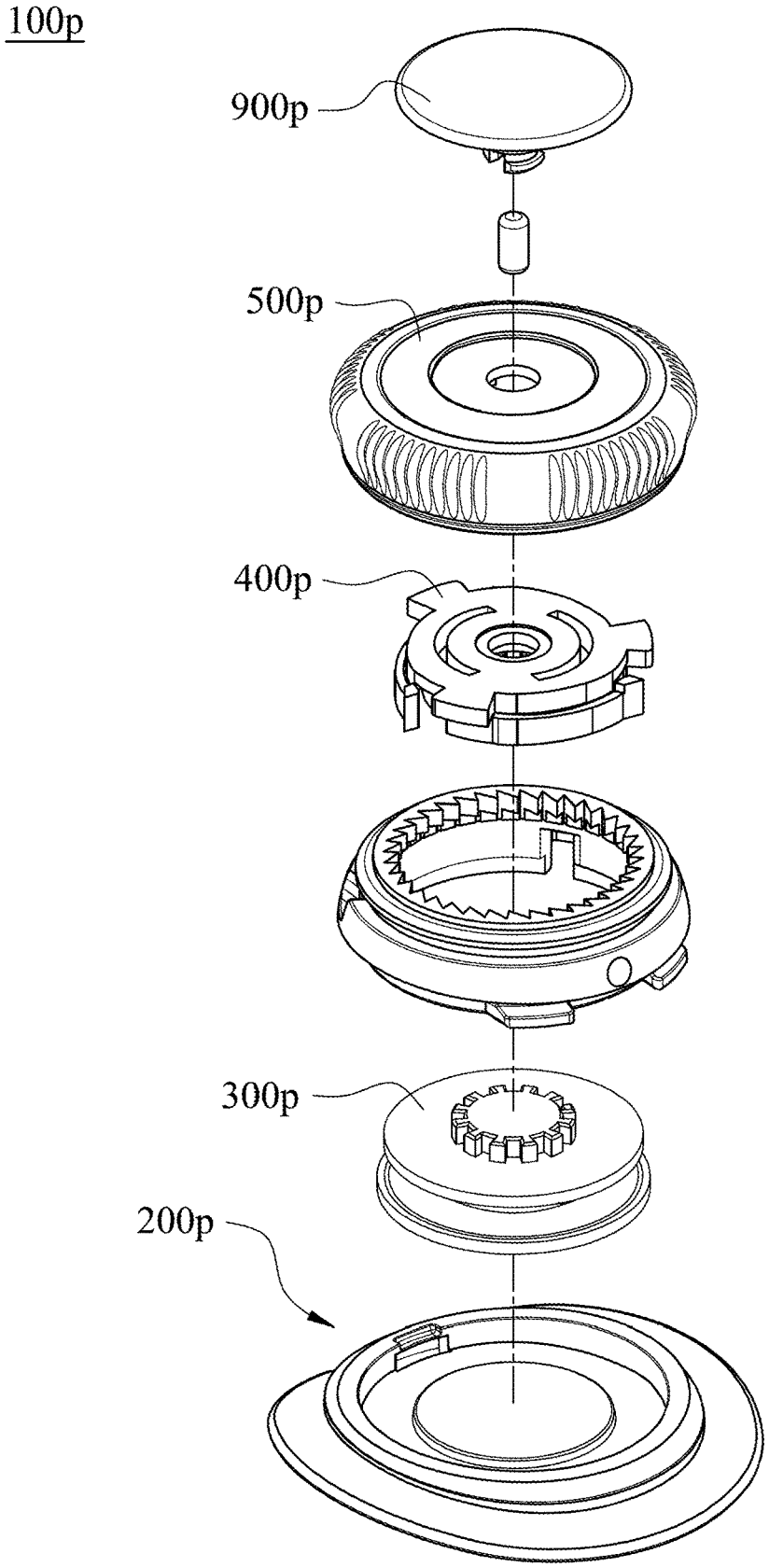
FIG. 37 shows one exploded view of a fastening device according to a 17th embodiment of the present disclosure.
Figure 38:
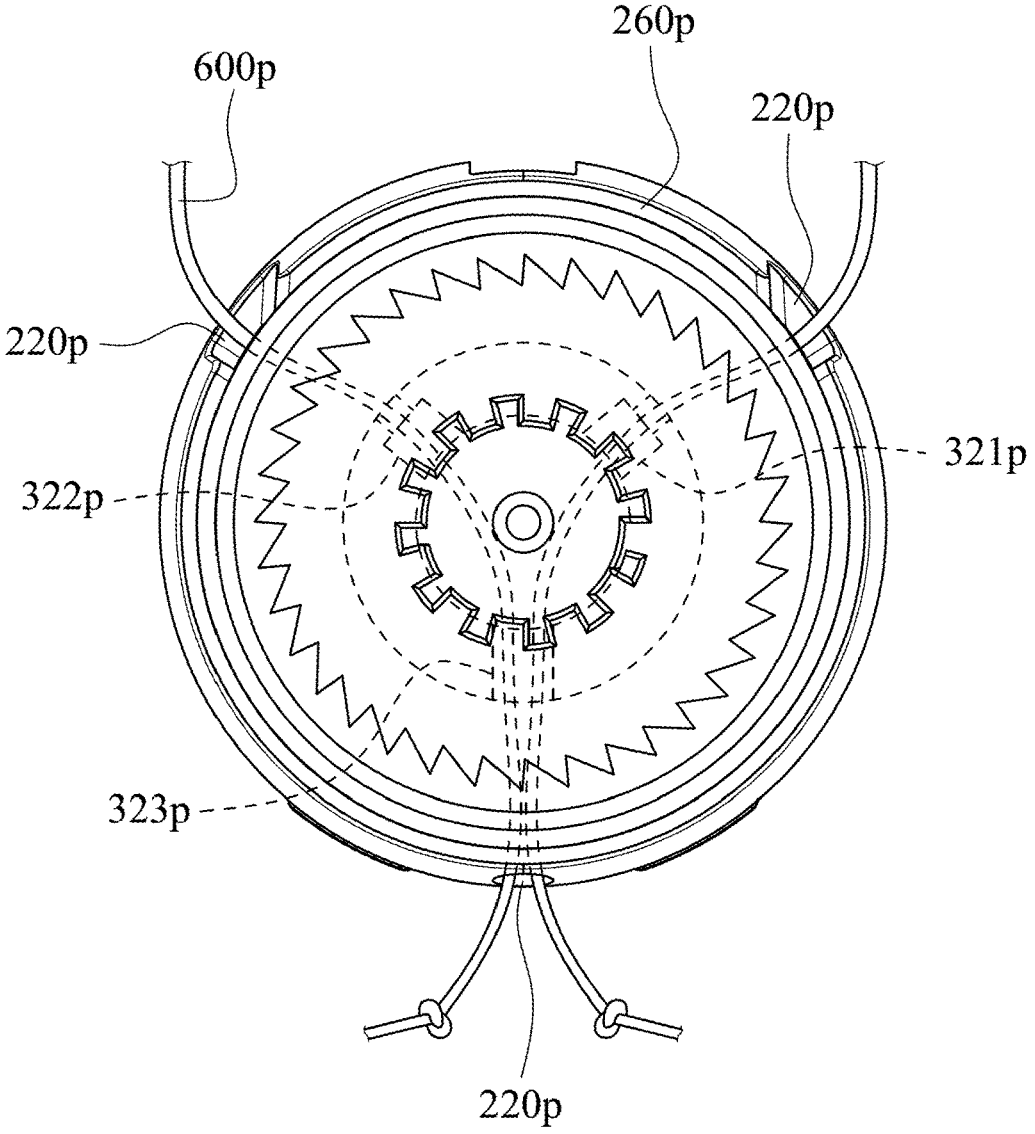
FIG. 38 shows a partial top view of the fastening device of FIG. 37.
Figure 39:
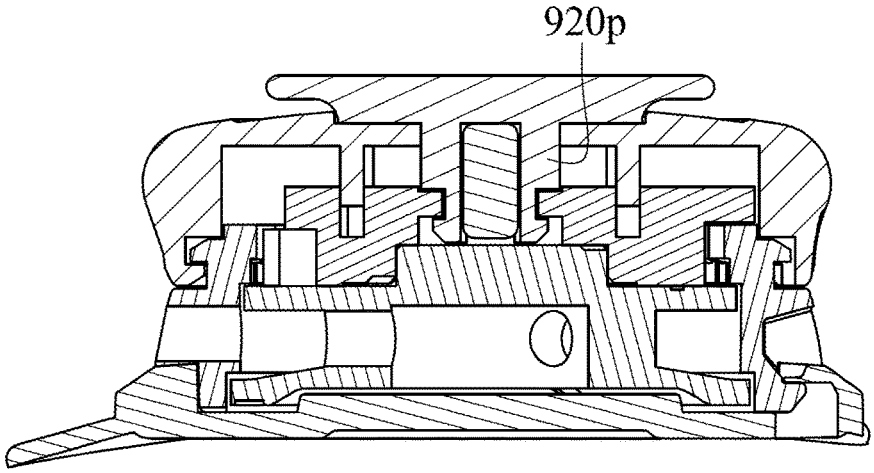
FIG. 39 shows a cross-sectional view of a fastening device of FIG. 37.

Please refer to FIG. 37, FIG. 38 and FIG. 39, FIG. 37 shows one exploded view of a fastening device 100*p* according to a 17th embodiment of the present disclosure, FIG. 38 shows a top view of the fastening device 100*p* of FIG. 37, and FIG. 39 shows a cross-sectional view of a fastening device 100*p* of FIG. 37. The fastening device 100*p* includes a case 200*p*, a spool 300*p*, a locking unit 400*p*, a knob 500*p* and a controlling set 900*p*.

The controlling set 900*p* includes two clamping arms 920*p* coupled to the locking unit 400*p*. The locking unit 400*p* can be lifted by pulling the controlling set 900*p* upward.

The housing 260*p* can include three side holes 220*p*, and the spool 300*p* can include a first opening 321*p*, a second opening 322*p* and a third opening 323*p*. The spool 300*p* is aligned with the housing 260*p* such that the three side holes 220*p* can correspond to the first opening 321*p*, the second opening 322*p* and the third opening 323*p*, respectively, to allow the lace 600*p* to pass therethrough.

Figure 40:
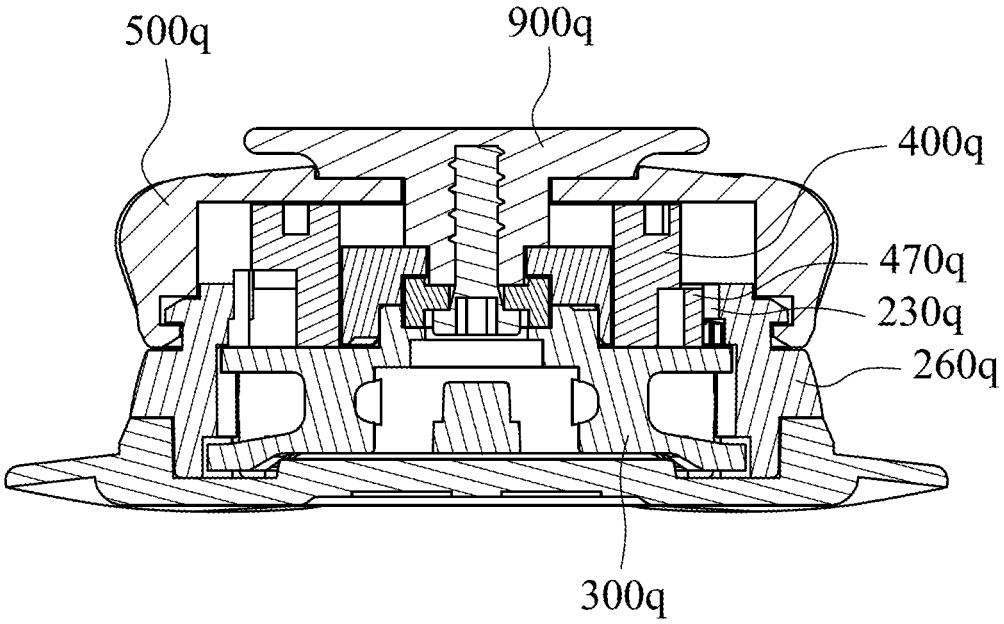
FIG. 40 shows a cross-sectional view of a fastening device according to an 18th embodiment of the present disclosure.

Please refer to FIG. 40. FIG. 40 shows a cross-sectional view of a fastening device 100*q* according to an 18th embodiment of the present disclosure. The fastening device 100*q* includes a case (not labeled), a spool 300*q*, a locking unit 400*q*, a knob 500*q* and a controlling set 900*q*.

The fastening device 100*q* is similar to the fastening device 100*m*, but the locking unit 400*q* includes the pawl arms 470*q* to engage with the side teeth 230*q* on the housing 260*q*.

Figure 41:
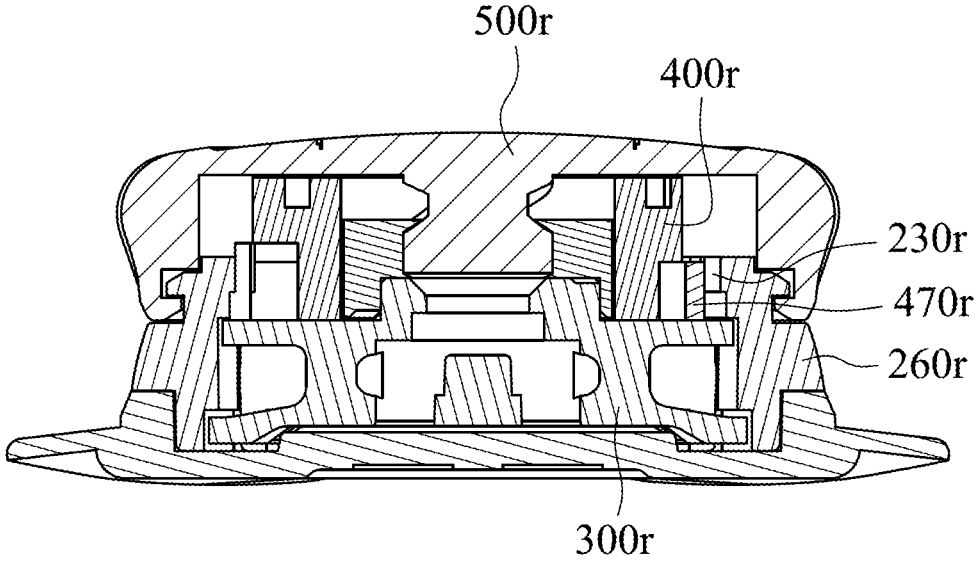
FIG. 41 shows a cross-sectional view of a fastening device according to a 19th embodiment of the present disclosure.

Please refer to FIG. 41. FIG. 41 shows a cross-sectional view of a fastening device 100*r* according to a 19th embodiment of the present disclosure. The fastening device 100*r* includes a case (not labeled), a spool 300*r*, a locking unit 400*r* and a knob 500*r*.

The fastening device 100*r* is similar to the fastening device 100*n*, but the locking unit 400*r* includes the pawl arms 470*r* to engage with the side teeth 230*r* on the housing 260*r*.

Figure 42:
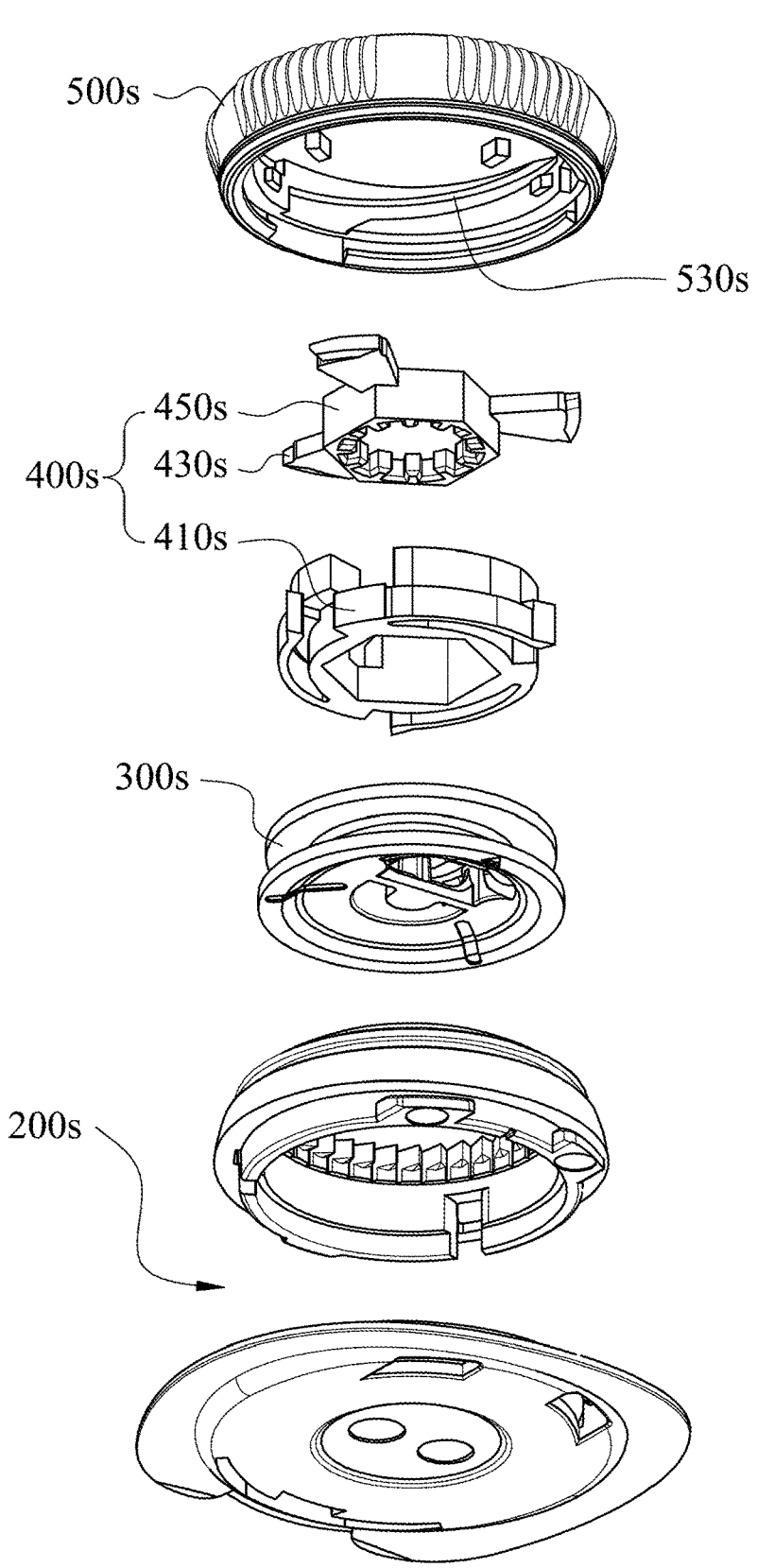
FIG. 42 shows an exploded view of a fastening device according to a 20th embodiment of the present disclosure.
Figure 43:
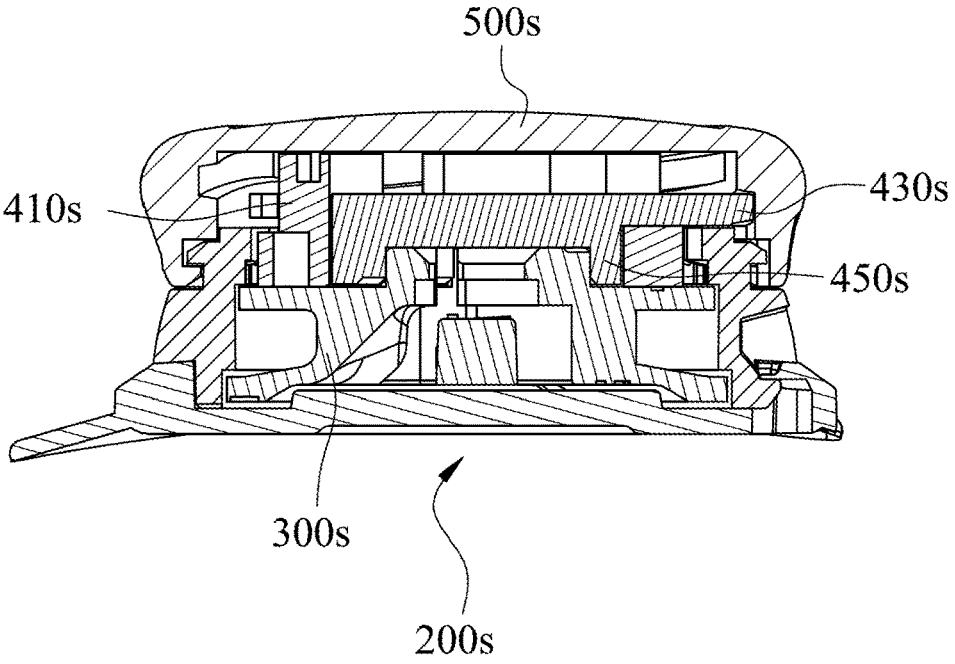
FIG. 43 shows a cross-sectional view of the fastening device of FIG. 42.

Please refer to FIG. 42 and FIG. 43, FIG. 42 shows an exploded view of a fastening device 100*s* according to a 20th embodiment of the present disclosure, and FIG. 43 shows a cross-sectional view of the fastening device 100*s* of FIG. 42. The fastening device 100*s* includes a case 200*s*, a spool 300*s*, a locking unit 400*s* and a knob 500*s*.

The locking unit 400*s* includes an engaging disc 410*s* and an inner gear 450*s*. The inner gear 450*s* is located in a central hole of the engaging disc 410*s* and three guiding portions 430*s* are extended outwardly from the inner gear 450*s*. The knob 500*s* includes a spiral track 530*s* correspondent to the guiding portions 430*s*. The inner gear 450*s* can be guided and lifted by the spiral track 530*s* when the knob 500*s* is rotated, thereby allowing the locking unit 400*s* to decouple from the spool 300*s*.

To sum up, in the fastening device of the present disclosure, the locking unit can be a one-piece element or can be composed of two elements, i.e., the engaging disc and the inner gear, and when the locking unit is composed of two elements, only one of the two elements is lifted. The pawl arm can be located on the locking unit while the teeth are located on the housing, or the pawl arm can be located on the housing while the teeth is located on the locking unit. The knob and housing can be combined via an engagement between the engaged portion and the mounted portion, and after the knob is engaged with the housing, the housing, the locking unit, the knob and the spool are combined and restricted. The base can still be separated from the housing while the engagement between other elements is not affected because the base is only restricted by the housing.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fastening device, which is for fastening and loosening a lace, the fastening device comprising:

a case, comprising:

a housing, comprising a receiving space;

a base detachably connected to the housing; and a mounted portion located on the housing;

a spool received in the receiving space and configured for the lace to be wound therearound;

a knob comprising an engaged portion for engaging with the mounted portion, such that the knob is coupled to the housing; and a locking unit received in the receiving space;

wherein when the knob is rotated relative to the case in a fastening direction, the spool is allowed to rotate in the fastening direction for fastening the lace, when the knob is rotated relative to the case in a loosening direction, the spool is allowed to freely rotate in the loosening direction to release the lace, and as the knob is engaged with the housing via an engagement between the mounted portion and the engaged portion, the housing, the locking unit, the knob and the spool are combined;

wherein rotating the knob relative to the case in the loosening direction causes the locking unit to be switched from a first position to a second position along an axial direction, the locking unit is coupled to the spool to prohibit the spool from rotating in the loosening direction when the locking unit is at the first position, the spool is allowed to be rotated toward the loosening direction when the locking unit is at the second position, and a relative position along the axial direction between the engaged portion and the mounted portion is fixed as the locking unit is switched from the first position to the second position and a force exerted on the knob is removed.

2. The fastening device of claim 1, wherein the spool comprises a first opening, a second opening and at least one sloped surface, and a first end of the lace passes through the first opening toward the at least one sloped surface.

* * * * *